US007692615B2

(12) United States Patent
Morita

(10) Patent No.: US 7,692,615 B2
(45) Date of Patent: Apr. 6, 2010

(54) DISPLAY DRIVER, ELECTRO-OPTICAL DEVICE, AND METHOD OF DRIVING ELECTRO-OPTICAL DEVICE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1082 days.

(21) Appl. No.: 10/928,174

(22) Filed: Aug. 30, 2004

(65) Prior Publication Data

US 2005/0078074 A1 Apr. 14, 2005

(30) Foreign Application Priority Data

Sep. 26, 2003 (JP) ..... 2003-334978

(51) Int. Cl.
*G09G 3/36* (2006.01)

(52) U.S. Cl. ..... 345/96; 345/209

(58) Field of Classification Search ..... 345/96, 345/209

See application file for complete search history.

(56) References Cited

U.S. PATENT DOCUMENTS

| | | | | |
|---|---|---|---|---|
| 6,118,421 | A * | 9/2000 | Kawaguchi et al. | 345/89 |
| 6,335,719 | B1 * | 1/2002 | An et al. | 345/98 |
| 6,924,784 | B1 * | 8/2005 | Yeo et al. | 345/98 |
| 6,937,216 | B1 * | 8/2005 | Ishiyama | 345/87 |
| 7,088,350 | B2 | 8/2006 | Miyazawa | |
| 7,215,332 | B2 | 5/2007 | Miyazawa | |
| 2003/0132907 | A1 | 7/2003 | Lee et al. | |
| 2005/0024308 | A1 | 2/2005 | Ishiyama | |

FOREIGN PATENT DOCUMENTS

| | | |
|---|---|---|
| CN | 1432989 A | 7/2003 |
| JP | A-04-251288 | 9/1992 |
| JP | A 6-38149 | 2/1994 |
| JP | A-6-102838 | 4/1994 |
| JP | A-08-063128 | 3/1996 |
| JP | A-10-031201 | 2/1998 |
| JP | A-2001-092424 | 4/2001 |
| JP | A-2003-177722 | 6/2003 |

OTHER PUBLICATIONS

U.S. Appl. No. 10/912,247, filed Aug. 6, 2004, Morita.
U.S. Appl. No. 10/913,526, filed Aug. 9, 2004, Morita.
U.S. Appl. No. 10/913,464, filed Aug. 9, 2004, Morita.

* cited by examiner

*Primary Examiner*—Amr Awad
*Assistant Examiner*—Yong Sim
(74) *Attorney, Agent, or Firm*—Oliff & Berridge PLC

(57) ABSTRACT

A display driver which drives a data line connected to a pixel electrode through a switching element, the pixel electrode facing a common electrode with an electro-optical substance interposed, and a voltage being supplied to the common electrode based on a polarity reversal signal. The display driver includes: a polarity reversal signal generation circuit which generates the polarity reversal signal which specifies the timing at which the polarity of a voltage applied to the electro-optical substance is reversed; and a driver section which supplies a drive voltage based on display data to the data line so that the polarity of the voltage applied to the electro-optical substance is reversed in synchronization with the polarity reversal signal. The polarity reversal signal generation circuit generates the polarity reversal signal by delaying a signal generated based on a horizontal synchronization signal and a vertical synchronization signal, the horizontal synchronization signal specifying a horizontal scan period and the vertical synchronization signal specifying a vertical scan period.

9 Claims, 24 Drawing Sheets

FIG. 17

| ICID | FUNCTION |
| --- | --- |
| L | MASTER MODE (POL OUTPUT) |
| H | SLAVE MODE (POL INPUT) |

DISPLAY DRIVER, ELECTRO-OPTICAL DEVICE, AND METHOD OF DRIVING ELECTRO-OPTICAL DEVICE

Japanese Patent Application No. 2003-334978, filed on Sep. 26, 2003, is hereby incorporated by reference in its entirety.

BACKGROUND OF THE INVENTION

The present invention relates to a display driver, an electro-optical device, and a method of driving an electro-optical device.

In an active matrix liquid crystal device (electro-optical device in a broad sense), the operation of writing data into a liquid crystal (electro-optical substance in a broad sense) layer in each pixel through switching elements connected with one scan line is performed by a dot sequential drive. A scan line of the liquid crystal device is sequentially selected by a scan driver, and a data line of a liquid crystal device is driven by a data driver (display driver) based on display data. The scan driver and the data driver are timing-controlled by a display controller.

There may be a case where display unevenness occurs due to bias of voltage applied to a liquid crystal. The liquid crystal deteriorates if the polarity of the voltage applied to the liquid crystal remains unchanged. In order to prevent occurrence of these problems, a polarity reversal drive is performed in which the polarity of the voltage applied to the liquid crystal is reversed at a given timing. In the polarity reversal drive, voltage is applied to one end of the liquid crystal so that the polarity is reversed with respect to the potential applied to the other end of the liquid crystal. The polarity means the polarity of the voltage applied between both ends of the liquid crystal. In the active matrix liquid crystal device using a thin-film transistor (TFT), potential applied to a common electrode which faces a pixel electrode through a liquid crystal is changed in order to perform the polarity reversal drive.

As the polarity reversal drive, a frame reversal drive in which the polarity is reversed in units of vertical scan periods, a line reversal drive in which the polarity is reversed in units of horizontal scan periods, a polarity reversal drive in which a dot reversal drive in which the polarity is reversed in each dot is combined with the line reversal drive, and the like have been proposed.

The polarity reversal drive is performed in synchronization with a polarity reversal signal. The polarity reversal signal is generated by the display controller. The display controller generates the polarity reversal signal together with a horizontal synchronization signal which specifies the horizontal scan period and a vertical synchronization signal which specifies the vertical scan period in order to control the display timing. The polarity reversal signal is generated by a circuit disclosed in Japanese Patent Application Laid-open No. 6-38149, for example.

BRIEF SUMMARY OF THE INVENTION

According to a first aspect of the present invention, there is provided a display driver which drives a data line connected to a pixel electrode through a switching element, the pixel electrode facing a common electrode with an electro-optical substance interposed, and a voltage being supplied to the common electrode based on a polarity reversal signal, the display driver comprising:

a polarity reversal signal generation circuit which generates the polarity reversal signal which specifies the timing at which the polarity of a voltage applied to the electro-optical substance is reversed; and a driver section which supplies a drive voltage based on display data to the data line so that the polarity of the voltage applied to the electro-optical substance is reversed in synchronization with the polarity reversal signal, wherein the polarity reversal signal generation circuit generates the polarity reversal signal by delaying a signal generated based on a horizontal synchronization signal and a vertical synchronization signal, the horizontal synchronization signal specifying a horizontal scan period and the vertical synchronization signal specifying a vertical scan period.

According to a second aspect of the present invention, there is provided an electro-optical device comprising:

a plurality of scan lines;

a plurality of data lines;

a plurality of pixel electrodes connected to the scan lines and the data lines;

a common electrode which faces the pixel electrodes with an electro-optical substance interposed; and the above-described display driver.

According to a third aspect of the present invention, there is provided an electro-optical device comprising:

a scan line, first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data line, and the other ends of the first to third demultiplex switching elements being respectively connected to the first to third color component switching elements;

a common electrode which faces the first to third pixel electrodes with an electro-optical substance interposed; and the above-described display driver which supplies a drive voltage to the data line, the drive voltage being based on one of the multiplexed first to third color component data signals.

According to a fourth aspect of the present invention, there is provided an electro-optical device comprising:

a plurality of scan lines;

first and second groups of data lines;

a plurality of pixel electrodes respectively connected to the scan lines and the data lines of the first and second groups;

a common electrode facing the pixel electrodes with an electro-optical substance interposed;

the above-described display driver which is set to the master mode and supplies a drive voltage based on display data to the data line belonging to the first group; and the above-described display driver which is set to the slave mode and supplies a drive voltage based on display data to the data line belonging to the second group, wherein:

the display driver in the master mode supplies the polarity reversal signal to the display driver in the slave mode; and the display driver in the slave mode receives the polarity reversal signal from the display driver in the master mode, and drives the data lines of the second group based on the polarity reversal signal.

According to a fifth aspect of the present invention, there is provided an electro-optical device comprising:

a scan line;

first and second groups of first to third color component switching elements connected to the scan line;

first and second groups of first to third pixel electrodes respectively connected to the first and second groups of the first to third color component switching elements;

first and second groups of data lines through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data lines of the first and second groups, and the other ends of the first to third demultiplex switching elements being respectively connected to the first to third color component switching elements of the first and second groups;

a common electrode which faces the first to third pixel electrodes of the first and second groups with an electro-optical substance interposed;

the above-described display driver which is set in a master mode and supplies a drive voltage based on each of the multiplexed first to third color component data signals to the data lines of the first group; and the above-described display driver which is set in a slave mode and supplies a drive voltage based on each of the multiplexed first to third color component data signals to the data lines of the second group, wherein:

the display driver in the master mode supplies the polarity reversal signal to the display driver in the slave mode; and the display driver in the slave mode receives the polarity reversal signal from the display driver in the master mode, and drives the data lines of the second group based on the polarity reversal signal.

According to a sixth aspect of the present invention, there is provided a method of driving an electro-optical device which includes:

a scan line;

first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data line, and the other ends of the first to third demultiplex switching elements being respectively connected to the first to third color component switching elements; and a common electrode which faces the first to third pixel electrodes with an electro-optical substance interposed, the method comprising:

generating a polarity reversal signal by delaying a signal generated based on a horizontal synchronization signal and a vertical synchronization signal, the horizontal synchronization signal specifying a horizontal scan period, and the vertical synchronization signal specifying a vertical scan period; and performing first to fourth steps on the demultiplexers in a state in which a common electrode voltage in synchronization with the polarity reversal signal is supplied to the common electrode, wherein:

in the first step, all the first to third demultiplex switching elements are made electrically conductive by the first to third demultiplex control signals, and then all the first to third demultiplex switching elements are made non-conductive;

in the second step, only the first demultiplex switching element is made electrically conductive only for a period in which a drive voltage based on the first color component data signal is supplied to the first color component switching element;

in the third step, only the second demultiplex switching element is made electrically conductive only for a period in which a drive voltage based on the second color component data signal is supplied to the second color component switching element; and in the fourth step, only the third demultiplex switching element is made electrically conductive only for a period in which a drive voltage based on the third color component data signal is supplied to the third color component switching element.

BRIEF DESCRIPTION OF THE SEVERAL VIEWS OF THE DRAWING

FIG. 17 shows functions of a mode setting signal.

DETAILED DESCRIPTION OF THE EMBODIMENTS

Figure 1:
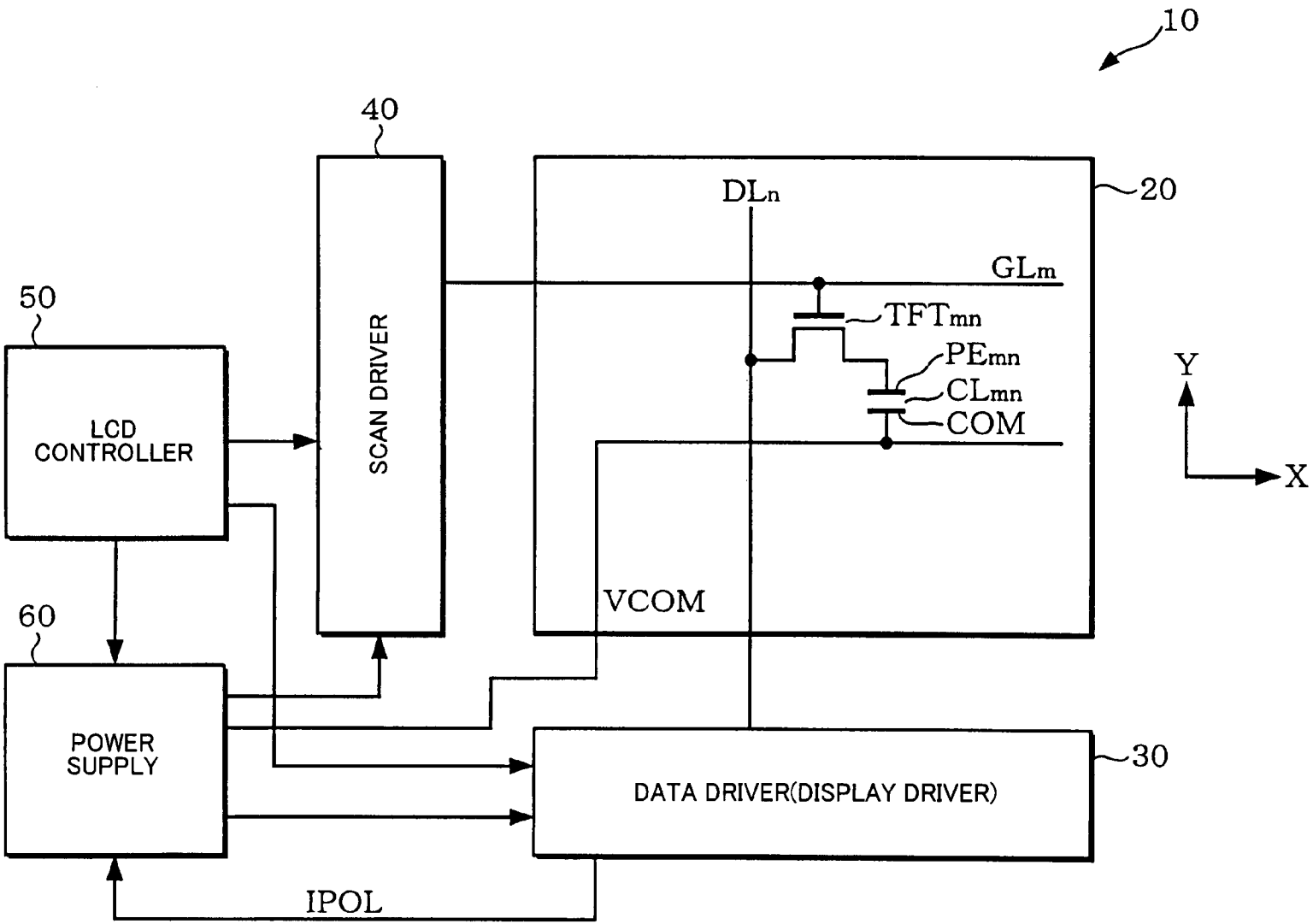
FIG. 1 is a block diagram showing a liquid crystal device to which is applied a display driver according to one embodiment of the present invention.

Embodiments of the present invention will be described below. Note that the embodiments described below do not in any way limit the scope of the invention laid out in the claims herein. In addition, not all of the elements of the embodiments described below should be taken as essential requirements of the present invention.

While an increase in the number of functions of a display driver has progressed, the number of data lines of a liquid crystal device has been also significantly increased due to an increase in display size. Therefore, since the number of terminals of the display driver for driving data lines is significantly increased, it is difficult to further increase the number of other terminals. An increase in the number of terminals increases the chip size, thereby increasing cost. Moreover, since an input buffer or an input/output buffer connected to the terminals consumes a large amount of power, an increase in the number of terminals increases power consumption. Therefore, it is desirable that the number of terminals of the display driver be as small as possible. However, since the circuit disclosed in Japanese Patent Application Laid-open No. 6-38149 makes it necessary to provide an input terminal for inputting a polarity reversal signal in the display driver, a further reduction of chip size and power consumption of the display driver cannot be achieved.

The circuit disclosed in Japanese Patent Application Laid-open No. 6-38149 may be provided in the display driver, but in this case, the output timing of the polarity reversal signal cannot be adjusted.

In the above polarity reversal drive, the display quality deteriorates if the difference between the change timing of the voltage applied to the common electrode and the change timing of the voltage applied to the pixel electrode is increased. In particular, in the case of using a plurality of display drivers, the display quality deteriorates to a large extent due to the difference between the polarity reversal timing of the display driver disposed at a position closer to the display controller and the polarity reversal timing of the display driver disposed at a position farther from the display controller. In an electro-optical device in which R, Q and B color component pixels are connected to a data line to which R, G, and B color component data signals in a multiplexed state are supplied by switch control, there is a difference between the change timing of the voltage applied to the common electrode and the change timing of the voltage applied to the pixel electrode, providing different charging times for the color components, whereby the display quality deteriorates to a large extent.

In order to prevent deterioration of the display quality, it is effective to adjust an output timing of the polarity reversal signal which specifies the polarity reversal timing. In particular, it is desirable that the output timing of the polarity reversal signal be adjusted based on the mounting state. However, since the circuit disclosed in Japanese Patent Application Laid-open No. 6-38149 cannot adjust the output timing of the polarity reversal signal, the display quality deteriorates depending on the mounting state.

The embodiments described below may provide a display driver, an electro-optical device, and a method of driving a display driver in which the number of terminals is reduced, leading to the reduction of cost and power consumption.

The following embodiments may also provide a display driver, an electro-optical device, and a method of driving a display driver enabling to reduce deterioration of the display quality caused by the difference in polarity reversal timings.

According to one embodiment of the present invention, there is provided a display driver which drives a data line connected to a pixel electrode through a switching element, the pixel electrode facing a common electrode with an electro-optical substance interposed, and a voltage being supplied to the common electrode based on a polarity reversal signal, the display driver comprising:

a polarity reversal signal generation circuit which generates the polarity reversal signal which specifies the timing at which the polarity of a voltage applied to the electro-optical substance is reversed; and a driver section which supplies a drive voltage based on display data to the data line so that the polarity of the voltage applied to the electro-optical substance is reversed in synchronization with the polarity reversal signal, wherein the polarity reversal signal generation circuit generates the polarity reversal signal by delaying a signal generated based on a horizontal synchronization signal and a vertical synchronization signal, the horizontal synchronization signal specifying a horizontal scan period and the vertical synchronization signal specifying a vertical scan period.

This display driver includes a polarity reversal signal generation circuit which generates the polarity reversal signal by delaying a signal generated based on the horizontal synchronization signal and the vertical synchronization signal. The number of terminals for inputting the polarity reversal signal from a display controller which controls the display driver can be thus reduced. This makes it possible to reduce the chip size and power consumption caused by an input buffer or an input/output buffer connected to the terminals, whereby a reduction of cost and power consumption can be implemented.

Moreover, since the polarity reversal signal generation circuit can delay the output timing of the polarity reversal signal generated as described above, the polarity reversal timing can be optimized, so that deterioration of the display quality due to the difference between the change timing of the common electrode voltage and the supply timing of the data signal to the pixel electrode can be reduced.

The display driver may further comprise:

a data latch which fetches display data for one horizontal scan supplied in synchronization with a dot clock signal, wherein:

the driver section may supply the drive voltage based on the display data fetched into the data latch to the data line so that the polarity of the voltage applied to the electro-optical substance is reversed in synchronization with the polarity reversal signal; and the polarity reversal signal generation circuit may generate the polarity reversal signal by delaying the signal generated based on the horizontal and vertical synchronization signals by a given number of the dot clock signals with reference to a change point of the horizontal synchronization signal.

In the display driver, the polarity reversal signal generation circuit may includes:

an output counter which counts the number of the dot clock signals with reference to the change point of the horizontal synchronization signal, and outputs a coincidence signal when the output counter counts a given number of the dot clock signals;

a first toggle flip-flop having an output which changes in synchronization with the vertical synchronization signal;

a second toggle flip-flop having an output which changes in synchronization with the horizontal synchronization signal;

a logic circuit which performs an exclusive-OR operation on the outputs from the first and second toggle flip-flops; and a flip-flop which fetches an output from the logic circuit based on the coincidence signal, and outputs the fetched output as the polarity reversal signal.

The output timing of the polarity reversal signal can be thus adjusted by simple configuration, whereby the polarity reversal timing can be optimized with high accuracy.

The display driver may further comprise a polarity reversal signal input/output terminal, and a mode setting input terminal used to set the display driver to a master mode or a slave mode, wherein:

the display driver may be set to the master mode when a first voltage is supplied to the mode setting input terminal;

the display driver may be set to the slave mode when a second voltage is supplied to the mode setting input terminal;

in the master mode, the polarity reversal signal may be output to outside through the polarity reversal signal input/output terminal, and the driver section may supply the drive voltage to the data line so that the polarity of the voltage applied to the electro-optical substance is reversed in synchronization with the polarity reversal signal; and in the slave mode, the polarity reversal signal may be input from outside through the polarity reversal signal input/output terminal, and the driver section may supply the drive voltage to the data line so that the polarity of the voltage applied to the electro-optical substance is reversed in synchronization with the polarity reversal signal.

A plurality of display drivers including the display driver set in the master mode and the display driver set in the slave mode may be used to drive an electro-optical device. In this time, since the polarity reversal timings of the display drivers set in the slave mode and the master mode can be adjusted with high accuracy, deterioration of the display quality due to the difference in the polarity reversal timings can be reduced.

According to one embodiment of the present invention, there is provided an electro-optical device comprising:

a plurality of scan lines;

a plurality of data lines;

a plurality of pixel electrodes connected to the scan lines and the data lines;

a common electrode which faces the pixel electrodes with an electro-optical substance interposed; and the above-described display driver.

This makes it possible to provide an electro-optical device which can reduce cost, power consumption, and deterioration of the display quality due to the difference in the polarity reversal timings.

According to one embodiment of the present invention, there is provided an electro-optical device comprising:

a scan line, first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data line, and the other ends of the first to third demultiplex switching elements being respectively connected to the first to third color component switching elements;

a common electrode which faces the first to third pixel electrodes with an electro-optical substance interposed; and the above-described display driver which supplies a drive voltage to the data line, the drive voltage being based on one of the multiplexed first to third color component data signals.

This makes it possible to provide an electro-optical device which is manufactured by a low temperature poly-silicon process and can reduce cost, power consumption, and deterioration of the display quality due to the difference in the polarity reversal timings.

According to one embodiment of the present invention, there is provided an electro-optical device comprising:

a plurality of scan lines;

a plurality of data lines each of which belongs to one of first and second groups;

a plurality of pixel electrodes respectively connected to the scan lines and the data lines;

a common electrode facing the pixel electrodes with an electro-optical substance interposed;

the above-described display driver which is set to the master mode and supplies a drive voltage based on display data to the data line belonging to the first group; and the above-described display driver which is set to the slave mode and supplies a drive voltage based on display data to the data line belonging to the second group, wherein:

the display driver set in the master mode supplies the polarity reversal signal to the display driver set in the slave mode; and the display driver set in the slave mode receives the polarity reversal signal from the display driver set in the master mode, and drives the data line belonging to the second group based on the polarity reversal signal.

Since the polarity reversal timings in the master mode and the slave mode can be adjusted, deterioration of the display quality in a display region including the first group of data lines and a display region including the second group of data lines due to the difference in the polarity reversal timings can be reduced.

According to one embodiment of the present invention, there is provided an electro-optical device comprising:

a scan line;

first and second groups of first to third color component switching elements connected to the scan line;

first and second groups of first to third pixel electrodes respectively connected to the first and second groups of the first to third color component switching elements;

first and second groups of data lines through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data lines of the first and second groups, and the other ends of the first to third demultiplex switching elements being respectively connected to the first to third color component switching elements of the first and second groups;

a common electrode which faces the first to third pixel electrodes of the first and second groups with an electro-optical substance interposed;

the above-described display driver which is set in a master mode and supplies a drive voltage based on each of the multiplexed first to third color component data signals to the data lines of the first group; and the above-described display driver which is set in a slave mode and supplies a drive voltage based on each of the multiplexed first to third color component data signals to the data lines of the second group, wherein:

the display driver in the master mode supplies the polarity reversal signal to the display driver in the slave mode; and the display driver in the slave mode receives the polarity reversal signal from the display driver in the master mode, and drives the data lines of the second group based on the polarity reversal signal.

Since the polarity reversal timings in the master mode and the slave mode can be adjusted, there can be provided an electro-optical device which is manufactured by a low temperature poly-silicon process and reduces deterioration of the display quality in a display region including the first group of data lines and a display region including the second group of data lines due to the difference in the polarity reversal timings.

According to one embodiment of the present invention, there is provided a method of driving an electro-optical device which includes:

a scan line;

first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data line, and the other ends of the first to third demultiplex switching elements being respectively connected to the first to third color component switching elements; and a common electrode which faces the first to third pixel electrodes with an electro-optical substance interposed, the method comprising:

generating a polarity reversal signal by delaying a signal generated based on a horizontal synchronization signal and a vertical synchronization signal, the horizontal synchronization signal specifying a horizontal scan period, and the vertical synchronization signal specifying a vertical scan period; and performing first to fourth steps on the demultiplexers in a state in which a common electrode voltage in synchronization with the polarity reversal signal is supplied to the common electrode, wherein:

in the first step, all the first to third demultiplex switching elements are made electrically conductive by the first to third demultiplex control signals, and then all the first to third demultiplex switching elements are made non-conductive;

in the second step, only the first demultiplex switching element is made electrically conductive only for a period in which a drive voltage based on the first color component data signal is supplied to the first color component switching element;

in the third step, only the second demultiplex switching element is made electrically conductive only for a period in which a drive voltage based on the second color component data signal is supplied to the second color component switching element; and in the fourth step, only the third demultiplex switching element is made electrically conductive only for a period in which a drive voltage based on the third color component data signal is supplied to the third color component switching element.

The electro-optical device cannot sufficiently write the first color component data signal if writing of the first color component data signal is started in a period in which the common electrode voltage changes. Since the second and third color component data signals are written after the common electrode voltage has been completely changed, the first color component is expressed thinly or deeply over the entire image, whereby the display quality deteriorates.

In this embodiment, the polarity reversal signal generation circuit can adjust the output timing of the polarity reversal signal generated based on the vertical synchronization signal and the horizontal synchronization signal. Therefore, the polarity reversal signal which changes at a timing earlier than the horizontal synchronization signal and the vertical synchronization signal can be generated by inverting the polarity reversal signal or delaying the polarity reversal signal for about one cycle. Therefore, the speed can be increased by precharging and the polarity reversal timing can be specified with high accuracy, whereby the display quality can be significantly improved.

These embodiments of the present invention are described below in detail with reference to the drawings.

1. Display Driver

FIG. 1 is a block diagram showing a liquid crystal device to which is applied a display driver according to one embodiment of the present invention.

A liquid crystal device (electro-optical device in a broad sense) may be incorporated into various electronic instruments such as a portable telephone, portable information instrument (PDA or the like), digital camera, projector, portable audio player, mass storage device, video camera, electronic notebook, or global positioning system (GPS).

A liquid crystal device 10 includes a liquid crystal display (LCD) panel 20 (display panel or electro-optical panel in a broad sense), a data driver 30 (display driver in a broad sense), a scan driver 40 (gate driver), and an LCD controller 50 (display controller in a broad sense). The data driver 30 has the function of a display driver in this embodiment.

The liquid crystal device 10 does not necessarily include all of these circuit blocks. The liquid crystal device 10 may have a configuration in which some of the circuit blocks are omitted.

The LCD panel 20 includes a plurality of scan lines (gate lines), each of the scan lines being provided in one of a plurality of rows, a plurality of data lines (source lines) which intersect the scan lines, each of the data lines being provided in one of a plurality of columns, and a plurality of pixels, each of the pixels being specified by one of the scan lines and one of the data lines. Each pixel includes a thin-film transistor (hereinafter abbreviated as "TFT") and a pixel electrode. The TFT is connected with the data line, and the pixel electrode is connected with the TFT.

In more detail, the LCD panel 20 is formed on a panel substrate such as a glass substrate. A plurality of scan lines GL1 to GLM (M is an integer of two or more; M is preferably three or more), arranged in the Y direction shown in FIG. 1 and extending in the X direction, and a plurality of data lines DL1 to DLN (N is an integer of two or more), arranged in the X direction and extending in the Y direction, are disposed on the panel substrate. The pixel is provided at a position corresponding to the intersecting point of the scan line GLm (1≦m≦M; m is an integer) and the data line DLn (1≦n≦N; n is an integer). The pixel includes the thin-film transistor TFTmn and the pixel electrode PEmn.

A gate electrode of the thin-film transistor TFTmn is connected with the scan line GLm. A source electrode of the thin-film transistor TFTmn is connected with the data line DLn. A drain electrode of the TFTmn is connected with the pixel electrode PEmn. A liquid crystal capacitor CLmn is formed between the pixel electrode PEmn and a common electrode COM which faces the pixel electrode PEmn through a liquid crystal element (electro-optical substance in a broad sense). A storage capacitor may be formed in parallel with the liquid crystal capacitor CLmn. The transmissivity of the pixel changes corresponding to the voltage applied between the pixel electrode PEmn and the common electrode COM. A common electrode voltage VCOM supplied to the common electrode COM is generated by the power supply circuit 60.

The LCD panel 20 is formed by attaching a first substrate on which the pixel electrode and the TFT are formed to a second substrate on which the common electrode is formed, and sealing a liquid crystal as an electro-optical substance between the two substrates, for example.

The data driver 30 drives the data lines DL1 to DLN of the LCD panel 20 based on display data for one horizontal scan. In more detail, the data driver 30 drives at least one of the data lines DL1 to DLN based on the display data.

The scan driver 40 scans the scan lines GL1 to GLM of the LCD panel 20. In more detail, the scan driver 40 sequentially selects the scan lines GL1 to GLM in one vertical scan period, and drives the selected scan line.

The LCD controller 50 outputs control signals to the scan driver 40, the data driver 30, and the power supply circuit 60 according to the content set by a host such as a CPU (not shown). In more detail, the LCD controller 50 supplies a horizontal synchronization signal HSYNC or a vertical synchronization signal VSYNC generated therein, a dot clock signal CPH, and display data to the data driver 30, and performs setting of various operation modes and the like for the data driver 30. The LCD controller 50 supplies the vertical synchronization signal VSYNC generated therein to the scan driver 40, and performs setting of various operation modes and the like for the scan driver 40. The LCD controller 50 performs setting of various power supply voltages for the power supply circuit 60.

The power supply circuit 60 generates various voltages supplied to the scan driver 40 and the common electrode voltage VCOM supplied to the common electrode COM based on a reference voltage supplied from the outside.

In FIG. 1, the power supply circuit 60 generates the common electrode voltage VCOM based on a polarity reversal signal IPOL from the data driver 30. The data driver 30 generates the polarity reversal signal IPOL adjusted corresponding to the change timing of the common electrode voltage VCOM, and performs a polarity reversal drive based on the polarity reversal signal IPOL. In the case where a delay of the polarity reversal signal IPOL does not pose a problem, the power supply circuit 60 generates the common electrode voltage VCOM based on the polarity reversal signal IPOL from the data driver 30 as shown in FIG. 1, whereby the polarity reversal timing can be generated at a timing convenient to the data driver 30 as shown by a precharge timing described later.

In the case where a delay of the polarity reversal signal IPOL poses a problem, the power supply circuit 60 generates the common electrode voltage VCOM based on the polarity reversal signal POL from the LCD controller 50, whereby an optimum polarity reversal timing corresponding to the mounting state of the LCD panel 20, the data driver 30, and the power supply circuit 60 in the liquid crystal device 10 can be realized.

In FIG. 1, the liquid crystal device 10 includes the LCD controller 50. However, the LCD controller 50 may be provided outside the liquid crystal device 10. The host (not shown) may be included in the liquid crystal device 10 together with the LCD controller 50.

At least one of the scan driver 40, the LCD controller 50, and the power supply circuit 60 may be provided in the data driver 30.

Some or all of the data driver 30, the scan driver 40, and the LCD controller 50 may be formed on the LCD panel 20. The data driver 30 and the scan driver 40 may be formed on a panel substrate on which the LCD panel 20 is formed, for example. The LCD panel 20 may be configured to include a plurality of data lines, a plurality of scan lines, a plurality of pixels, each of the pixels being specified by one of the data lines and one of the scan lines, and a data driver which drives the data lines. The pixels are formed in a pixel formation region of the LCD panel 20.

Figure 2:
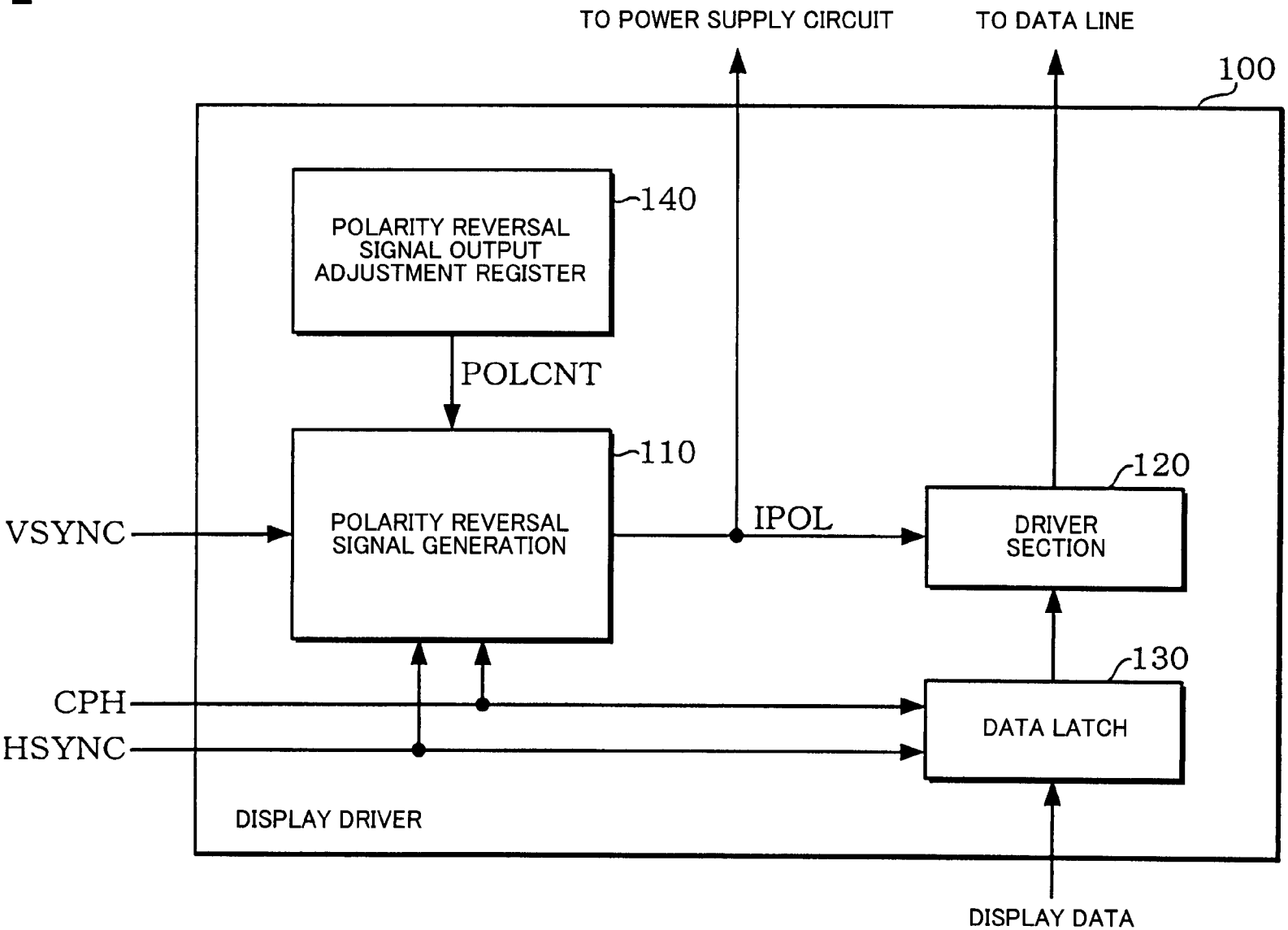
FIG. 2 is a block diagram schematically showing a display driver according to one embodiment of the present invention.

FIG. 2 is a block diagram schematically showing a display driver according to one embodiment of the present invention.

A display driver 100 shown in FIG. 2 may be used as the data driver 30 shown in FIG. 1. The display driver 100 drives the data line connected, through a switching element, with the pixel electrode which faces the common electrode to which voltage is supplied based on the polarity reversal signal IPOL through a liquid crystal. The display driver 100 includes a polarity reversal signal generation circuit 110 and a driver section 120. The polarity reversal signal generation circuit 110 generates the polarity reversal signal IPOL which designates the timing at which the polarity (with respect to a given reference potential) of the voltage applied to the liquid crystal interposed between the common electrode and the pixel electrode is reversed. The driver section 120 supplies a drive voltage based on the display data to the data line so that the polarity of the voltage applied to the liquid crystal is reversed in synchronization with the polarity reversal signal IPOL. The polarity reversal signal generation circuit 110 generates the polarity reversal signal IPOL by delaying a signal generated based on the horizontal synchronization signal HSYNC and the vertical synchronization signal VSYNC, the horizontal synchronization signal HSYNC specifying the horizontal scan period, and the vertical synchronization signal VSYNC specifying the vertical scan period.

It is preferable to adjust the output timing of the polarity reversal signal IPOL in units of dot clock signals CPH. For example, the display driver 100 includes a data latch 130 which fetches the display data for one horizontal scan supplied in synchronization with the dot clock signal CPH. The data latch 130 retains the display data for one horizontal scan based on the horizontal synchronization signal HSYNC. The driver section 120 supplies a drive voltage based on the display data fetched into the data latch 130 to the data line so that the polarity of the voltage applied to the electro-optical substance is reversed in synchronization with the polarity reversal signal IPOL. The polarity reversal signal generation circuit 110 generates the polarity reversal signal IPOL by delaying a signal generated based on the horizontal synchronization signal HSYNC and the vertical synchronization signal VSYNC by a given number of dot clock signals CPH with reference to the change point of the horizontal synchronization signal HSYNC.

The display driver 100 may include a polarity reversal signal output adjustment register 140. A value corresponding to the number of dot clock signals CPH is set in the polarity reversal signal output adjustment register 140 by the LCD controller 50. The polarity reversal signal generation circuit 110 counts the number of dot clock signals CPH, and changes the polarity reversal signal IPOL when the counter value coincides with the value set in the polarity reversal signal output adjustment register 140.

1.1 Polarity Reversal Drive

FIGS. 3A and 3B and FIGS. 4A and 4B are diagrams for illustrating the polarity reversal drive.

Figure 3A:
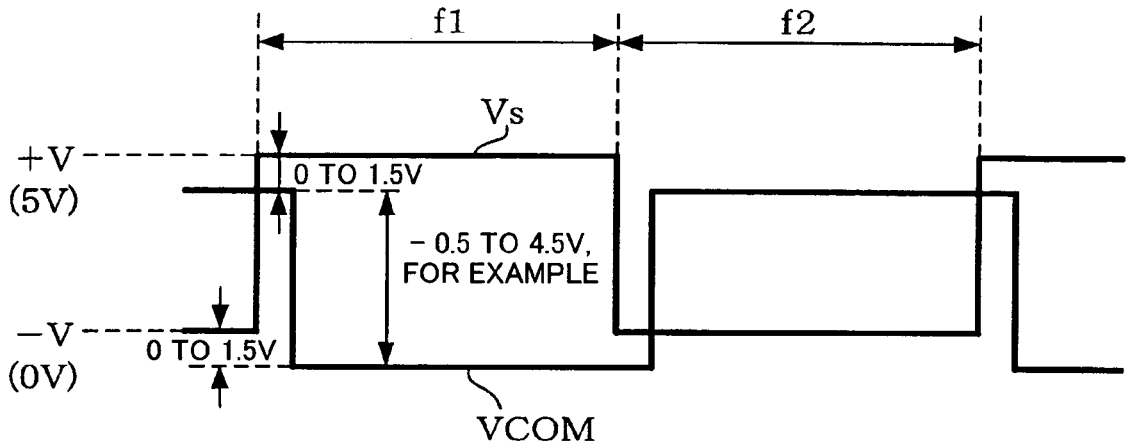
FIGS. 3A and 3B are diagrams for illustrating a frame reversal drive.
Figure 3B:
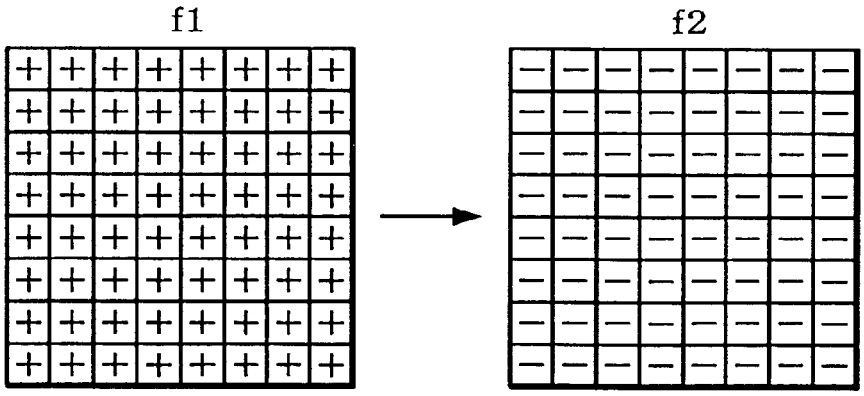

FIGS. 3A and 3B are diagrams for illustrating frame reversal drive. FIG. 3A schematically shows waveforms of the drive voltage of the data line and the common electrode voltage VCOM in the frame reversal drive. FIG. 3B schematically shows the polarity of the voltage applied to the liquid crystal corresponding to each pixel in one vertical scan period (one frame) when performing the frame reversal drive.

In the frame reversal drive, the polarity of the voltage applied to the liquid crystal is reversed in a frame cycle, as shown in FIG. 3A. Specifically, a voltage Vs supplied to the source electrode of the TFT connected with the data line is "+V" in a frame f1 and is "−V" in a frame f2. The voltage Vs is supplied to the pixel electrode. The polarity of the common electrode voltage VCOM supplied to the common electrode which faces the pixel electrode connected with the drain electrode of the TFT is also reversed almost in synchronization with the polarity reversal cycle shown in FIG. 3A. This causes the polarity of the voltage applied to the liquid crystal to be reversed in the frame f1 and the frame f2, as shown in FIG. 3B.

Figure 4A:
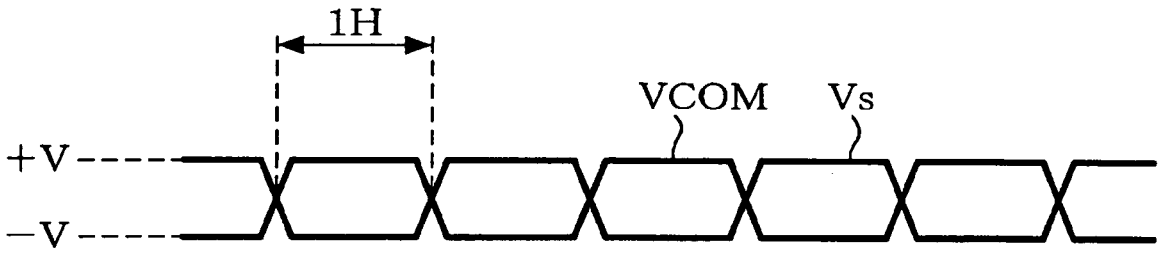
FIGS. 4A and 4B are diagrams for illustrating a line reversal drive.
Figure 4B:
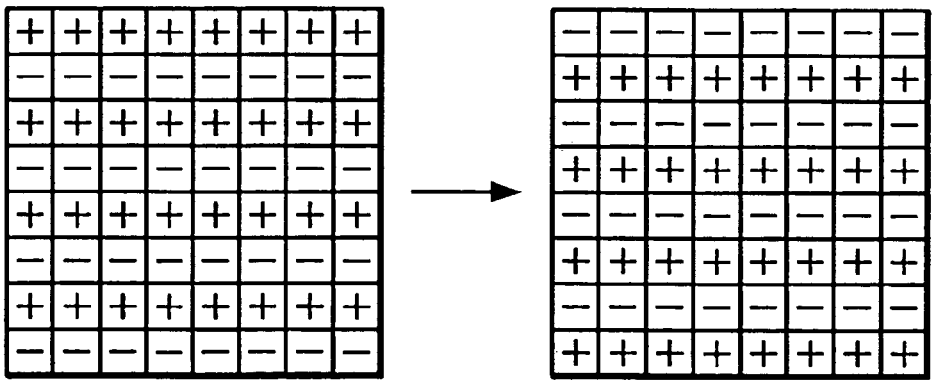

FIGS. 4A and 4B are diagrams for illustrating line reversal drive. FIG. 4A schematically shows waveforms of the drive voltage of the data line and the common electrode voltage VCOM in the line reversal drive. FIG. 4B schematically shows the polarity of the voltage applied to the liquid crystal corresponding to each pixel in each frame when performing the line reversal drive.

In the line reversal drive, the polarity of the voltage applied to the liquid crystal is reversed in each horizontal scan period (1H) and in each frame, as shown in FIG. 4A. Specifically, the voltage Vs supplied to the source electrode of the TFT connected with the data line is "+V" in 1H in the frame f1 and is "−V" in the next 1H. The voltage Vs is "−V" in 1H in the frame f2 and is "+V" in the next 1H.

The polarity of the common electrode voltage VCOM supplied to the common electrode which faces the pixel electrode connected with the drain electrode of the TFT is also reversed almost in synchronization with the polarity reversal cycle shown in FIG. 4A.

Figure 5:
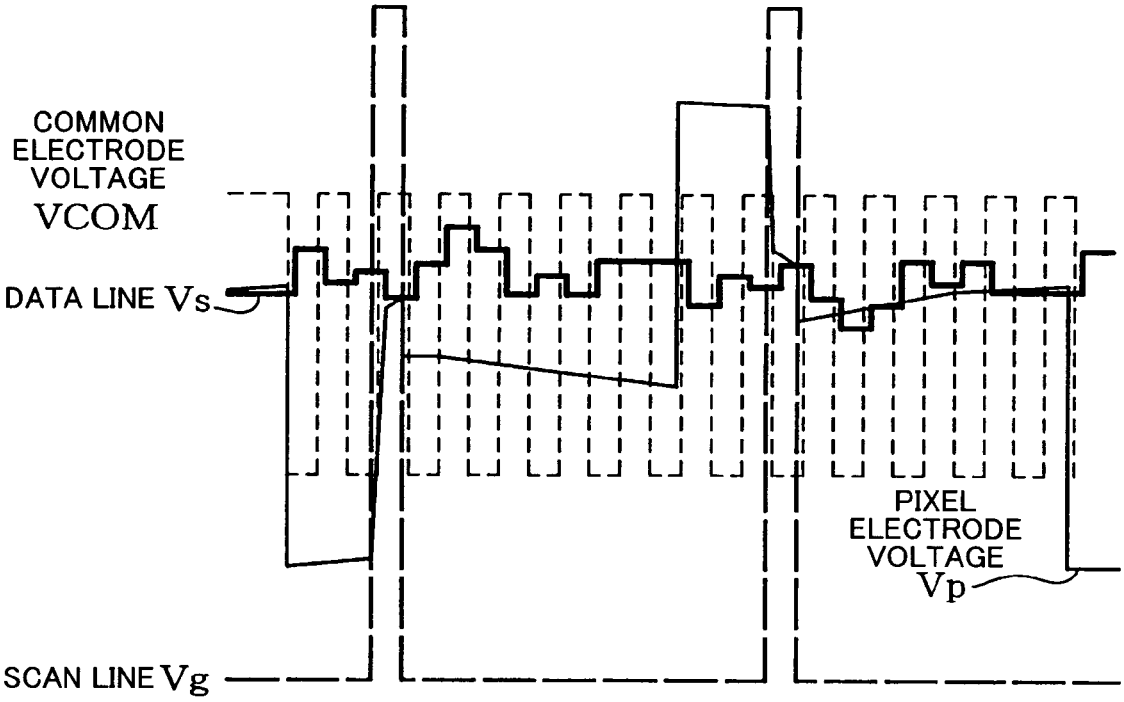
FIG. 5 is a waveform chart schematically showing an example of drive waveforms of an LCD panel.

FIG. 5 shows an example of drive waveforms of the LCD panel 20 of the liquid crystal device 10. In this case, the LCD panel is driven by the line reversal drive.

As described above, in the liquid crystal device 10, the data driver 30 to which the display driver 100 is applied drives the data line based on the display data for one horizontal scan in synchronization with the horizontal synchronization signal. The scan driver 40 sequentially selects the scan line, triggered by the vertical synchronization signal, and supplies a drive voltage Vg to the selected scan line. Therefore, the voltage Vs applied to the source electrode of the TFT connected with the selected scan line is supplied to the pixel electrode. The power supply circuit 60 supplies the common electrode voltage VCOM generated therein to the common electrode of the LCD panel 20 while reversing the polarity of the common electrode voltage VCOM in synchronization with the polarity reversal signal IPOL.

Electric charges corresponding to a voltage Vp between the voltage of the pixel electrode and the common electrode voltage VCOM of the common electrode are charged into the liquid crystal. Therefore, an image can be displayed when the voltage Vp exceeds a given threshold value Vcl. When the voltage Vp exceeds the given threshold value Vcl, the transmissivity of the pixel changes corresponding to the voltage level, whereby a grayscale representation can be performed.

The display quality is determined depending on the accuracy of the voltage applied to the liquid crystal. Therefore, the display quality may deteriorate if a difference occurs between the supply timing of the drive voltage based on the display data to the pixel electrode and the change timing of the common electrode voltage VCOM. Therefore, the generation timing of the polarity reversal signal IPOL, which specifies the polarity reversal timing, affects the display quality.

The above configuration enables the polarity reversal signal generation circuit 110 to change the polarity reversal signal IPOL at a timing earlier than the vertical synchronization signal VSYNC and the horizontal synchronization signal HSYNC by delaying the polarity reversal signal IPOL for about one cycle or inverting the polarity reversal signal IPOL. In the case of generating the polarity reversal signal merely based on the vertical synchronization signal VSYNC and the horizontal synchronization signal HSYNC, the polarity reversal signal cannot be changed at a timing earlier than the vertical synchronization signal VSYNC and the horizontal synchronization signal HSYNC. However, in this embodiment, the polarity reversal timing can be finely adjusted to an arbitrary timing.

In this embodiment, a timing signal necessary for the polarity reversal drive can be internally generated as the polarity reversal signal IPOL. Therefore, an input terminal for the polarity reversal signal from the LCD controller 50 can be reduced.

1.2 Polarity Reversal Signal Generation Circuit

Figure 6:
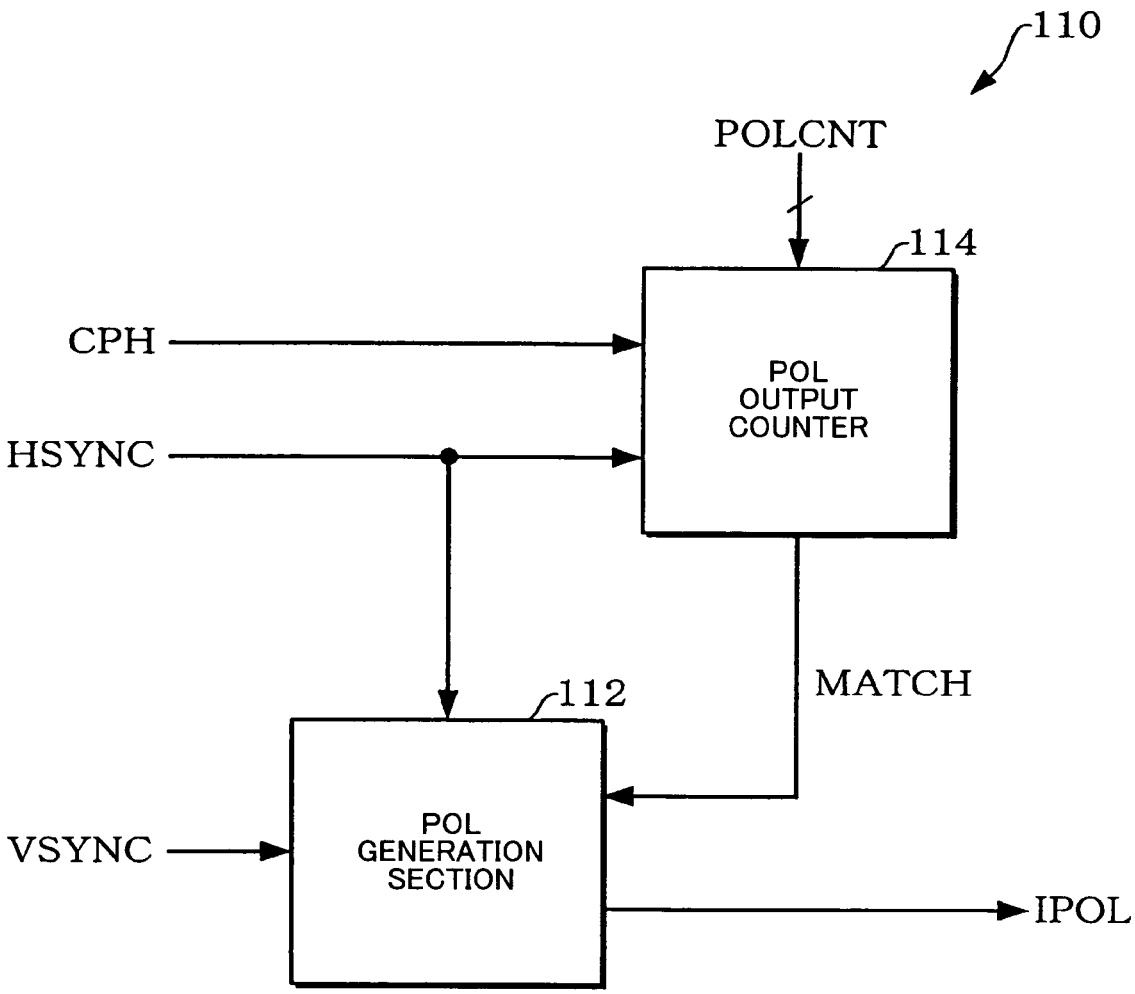
FIG. 6 is a block diagram schematically showing a polarity reversal signal generation circuit.

FIG. 6 is a block diagram schematically showing the polarity reversal signal generation circuit 110.

The polarity reversal signal generation circuit 110 includes a POL generation section 112 and a POL output counter 114. The POL generation section 112 generates the polarity reversal signal IPOL by delaying a signal generated based on the horizontal synchronization signal HSYNC and the vertical synchronization signal VSYNC. In more detail, the POL generation section 112 outputs a signal generated based on the horizontal synchronization signal HSYNC and the vertical synchronization signal VSYNC in synchronization with a coincidence signal MATCH.

A setting count signal POLCNT which shows the value set in the polarity reversal signal output adjustment register 140 is input to the POL output counter 114. The POL output counter 114 counts the number of dot clock signals CPH with reference to the change point of the horizontal synchronization signal HSYNC, and outputs the coincidence signal MATCH which is a pulse signal when the counter value coincides with the set value shown by the setting count signal POLCNT.

The following description is given on the assumption that the vertical synchronization signal VSYNC and the horizontal synchronization signal HSYNC are operated at a negative logic. Specifically, one vertical scan period is specified by a pulse in which the vertical synchronization signal VSYNC is set at the L level, and one horizontal scan period is specified by a pulse in which the horizontal synchronization signal HSYNC is set at the L level.

Figure 7:
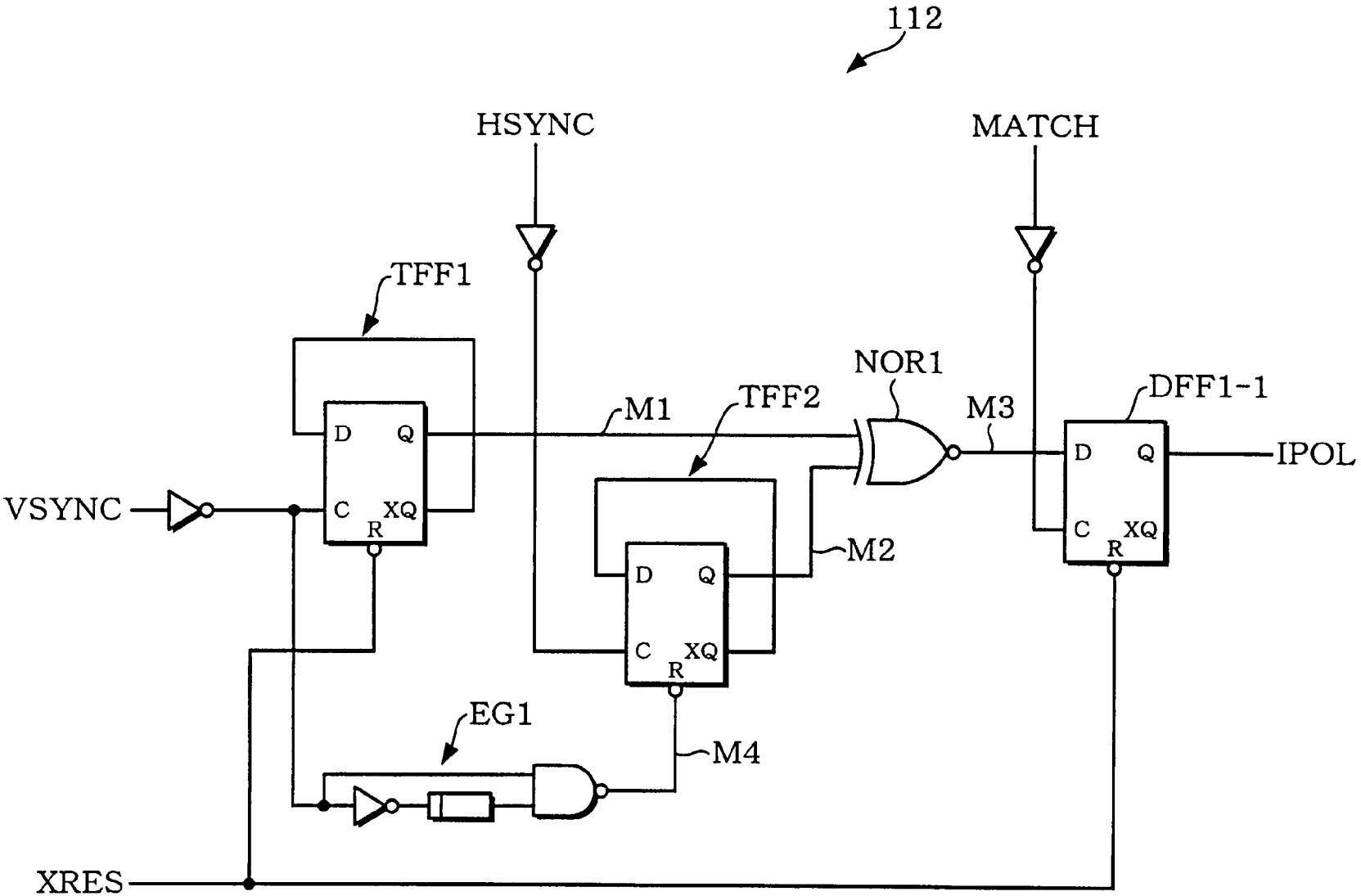
FIG. 7 is a circuit diagram showing the POL generation section of FIG. 6.

FIG. 7 is a circuit diagram showing the POL generation section 112.

The POL generation section 112 includes first and second toggle flip-flops (hereinafter abbreviated as "TFF1" and "TFF2"), a two-input, one-output NOR circuit (hereinafter abbreviated as "NOR1"), and a flip-flop (hereinafter abbreviated as "DFF1-1"). Each of the TFF1 and the TFF2 is formed by a D flip-flop (hereinafter abbreviated as "DFF"). In this example, the DFF retains the logical level of a signal input to a data input terminal D at the rising edge of a signal input to a clock input terminal C, and outputs a signal at the retained logical level from a data output terminal Q. The DFF is initialized when a signal input to a reset terminal R is set at the L level. In the case where the DFF includes an inversion data output terminal XQ, an inversion signal of the output signal from the data output terminal Q is output from the inversion data output terminal XQ. The TFF1 and the TFF2 are realized by inputting the signal output from the inversion data output terminal XQ of the DFF to the data input terminal D.

The output of the TFF1 changes in synchronization with the vertical synchronization signal VSYNC. In FIG. 7, the output of the TFF1 changes in synchronization with the rising edge of the inversion signal of the vertical synchronization signal VSYNC.

The output of the TFF2 changes in synchronization with the horizontal synchronization signal HSYNC. In FIG. 7, the output of the TFF2 changes in synchronization with the rising edge of the inversion signal of the horizontal synchronization signal HSYNC.

The NOR1 (logic circuit in a broad sense) outputs an output signal M3 which is the exclusive-NOR operation result of an output signal M1 from the TFF1 and an output signal M2 from the TFF2. Therefore, the output signal M3 is generated based on the exclusive-OR operation result of the output signal M1 from the TFF1 and the output signal M2 from the TFF2.

The DFF1-1 fetches the output signal M3 in synchronization with the rising edge of the coincidence signal MATCH, and outputs the output signal M3 as the polarity reversal signal IPOL.

The TFF1 and the DFF1-1 are initialized by an inversion reset signal XRES. The inversion reset signal XRES is a signal which becomes active at the L level.

The inversion signal of the vertical synchronization signal VSYNC is input to a rising edge detection circuit EG1. The TFF2 is initialized when an output signal M4 from the rising edge detection circuit EG1 is set at the L level. The rising edge detection circuit EG1 outputs a negative logic pulse when the rising edge detection circuit EG1 detects the rising edge of the inversion signal of the vertical synchronization signal VSYNC.

The circuit configuration is not limited to the circuit shown in FIG. 7 insofar as the exclusive-OR operation of the output signal M1 which changes in synchronization with the vertical synchronization signal VSYNC and the output signal M2 which changes in synchronization with the horizontal synchronization signal HSYNC is performed, and the exclusive-OR operation result is output as the polarity reversal signal IPOL based on the coincidence signal MATCH.

Figure 8:
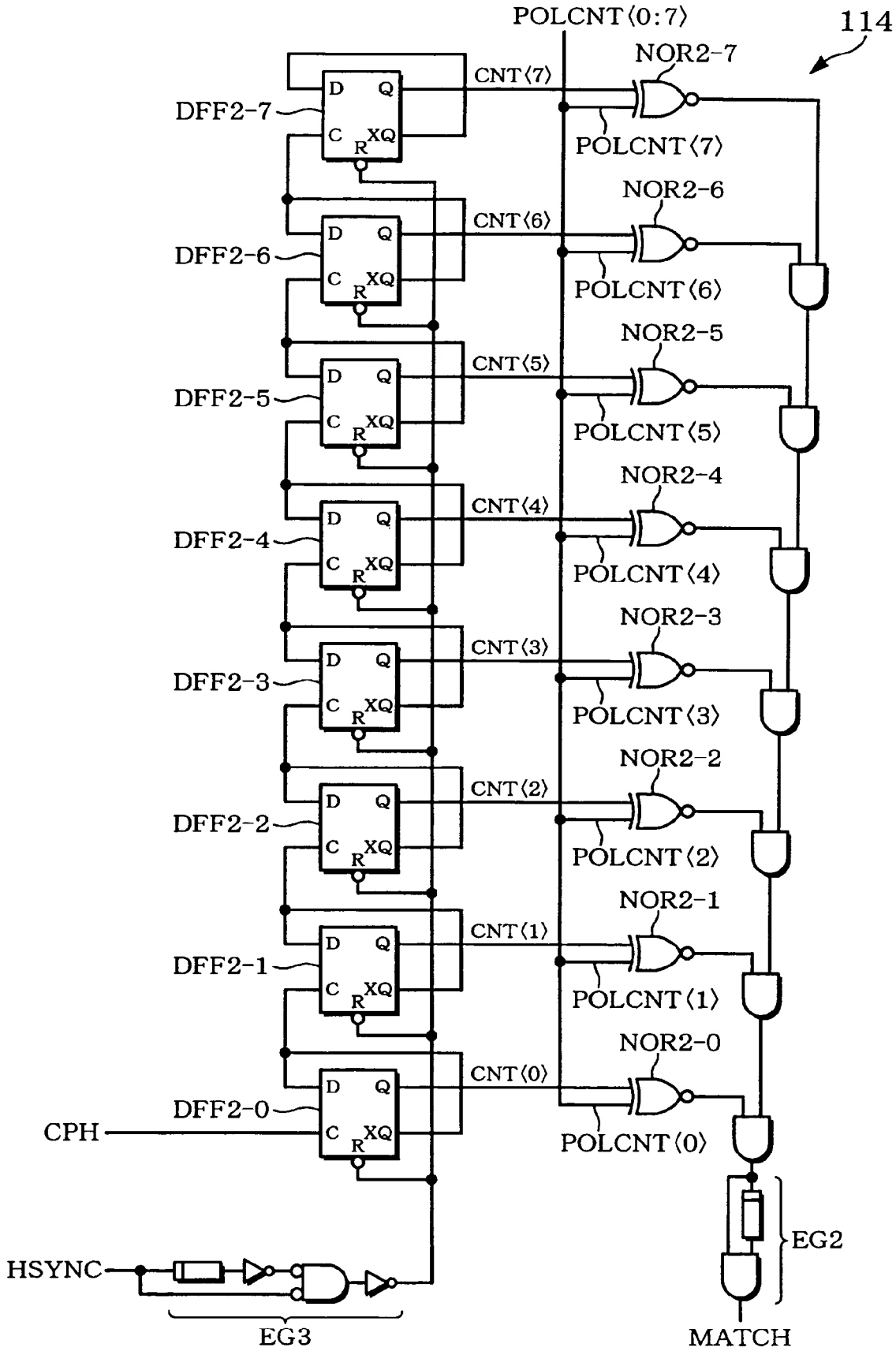
FIG. 8 is a circuit diagram showing the POL output counter of FIG. 6.

FIG. 8 is a circuit diagram showing the POL output counter 114. The POL output counter 114 includes a ripple-carry counter formed by eight D flip-flops DFF2-0 to DFF2-7. The dot clock signal CPH is input to a clock input terminal C of the DFF2-0 in the first stage. A data input terminal D and an inversion data output terminal XQ of the DFF2-0 and a clock input terminal C of the DFF2-1 in the next stage are connected, and a counter value CNT<0> is output from a data output terminal Q of the DFF2-0. A data input terminal D and an inversion data output terminal XQ of the DFF2-1 and a clock input terminal C of the DFF2-2 in the next stage are connected, and a counter value CNT<1> is output from a data output terminal Q of the DFF2-1. The counter value CNT<2:6> is similarly output from the DFF2-2 to DFF2-6. A data input terminal D and an inversion data output terminal XQ of the DFF2-7 are connected, and the counter value CNT<7> is output from a data output terminal Q of the DFF2-7. The ripple-carry counter performs the count operation in synchronization with the dot clock signal CPH, and outputs the counter value CNT<0:7>. Each bit of the counter value CNT<0:7> and each bit of the setting count signal POLCNT<0:7> are input to the NOR2-0 to NOR2-7.

The AND operation result of each output signal of the NOR2-0 to NOR2-7 is input to a falling edge detection circuit EG2. The output from the falling edge detection circuit EG2 is the coincidence signal MATCH.

The output signal from the falling edge detection circuit EG3 is input to the reset terminals R of the DFF2-0 to DFF2-7. The falling edge detection circuit EG3 outputs a negative logic pulse when the falling edge detection circuit EG3 detects the falling edge of the horizontal synchronization signal HSYNC.

The following description is given on the assumption that a value corresponding to the number "four" of dot clock signals CPH is set in the setting count signal POLCNT<0:7>.

Figure 9:
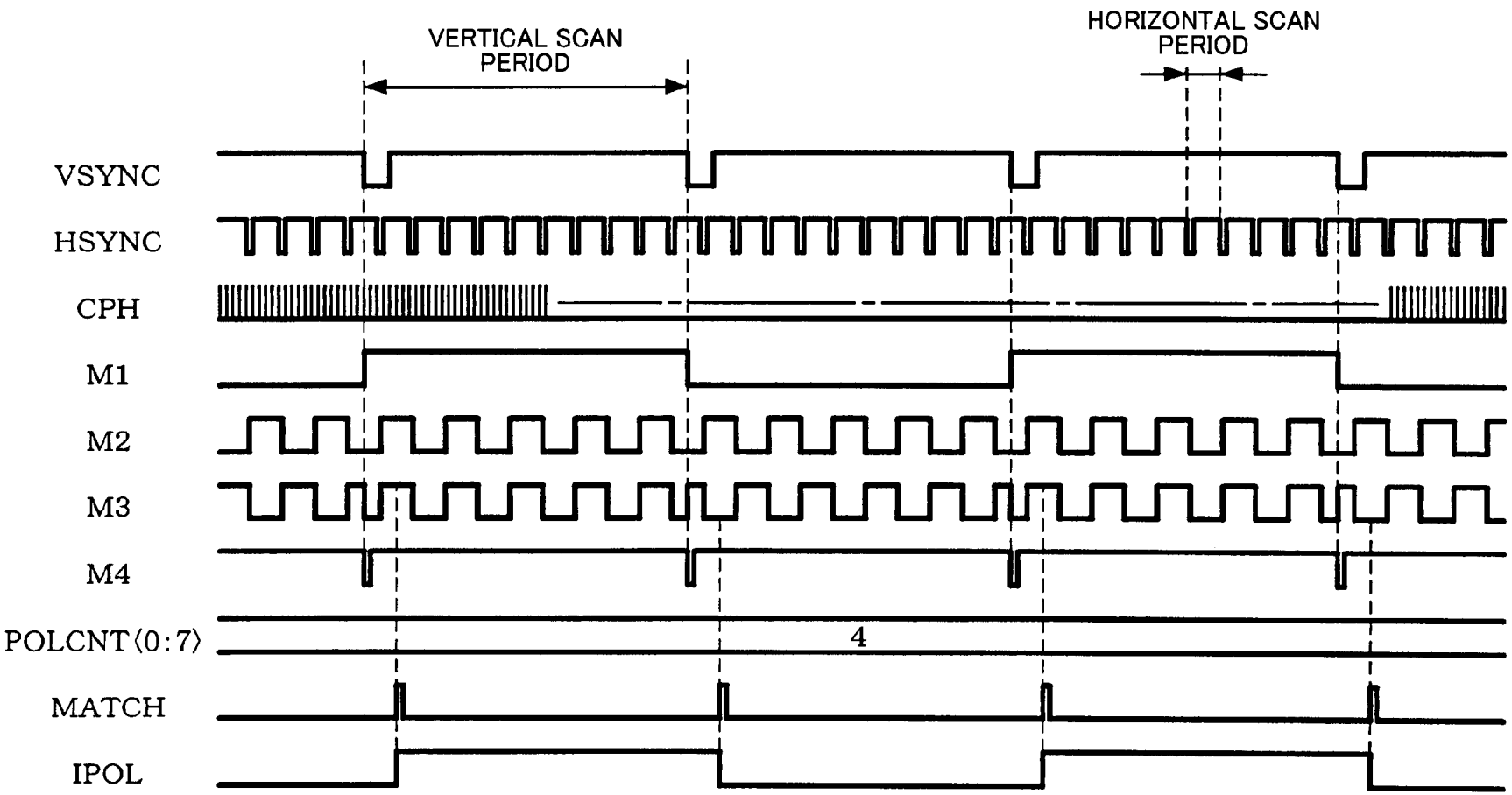
FIG. 9 is a timing chart showing an operation example of the polarity reversal signal generation circuit shown in FIGS. 6 to 8.

FIG. 9 is a timing chart showing an operation example of the polarity reversal signal generation circuit 110 shown in FIGS. 6 to 8.

The vertical scan period is specified by the falling edge of the vertical synchronization signal VSYNC, for example. Specifically, the vertical scan period may be the period between the falling edges of two continuous pulses of the vertical synchronization signal VSYNC. The horizontal scan period is specified by the falling edge of the horizontal synchronization signal HSYNC, for example. Specifically, the horizontal scan period may be the period between the falling edges of two continuous pulses of the horizontal synchronization signal HSYNC.

As shown in FIG. 7, the TFF1 outputs the output signal M1 which is reversed at each falling edge of the vertical synchronization signal VSYNC. The TFF2 outputs the output signal M2 which is reversed at each falling edge of the horizontal synchronization signal HSYNC. The TFF2 is initialized in each vertical scan period. When the output signal M1 is set at the H level, the output signal M3 of the NOR1 is almost the same as the output signal M2. When the output signal M1 is set at the L level, the output signal M3 of the NOR1 is almost the same as the inversion signal of the output signal M2.

The counter value initialized at the falling edge of the horizontal synchronization signal HSYNC is incremented at each rising edge of the dot clock signal CPH. When the counter value becomes four, the coincidence signal MATCH is output as a pulse at the H level.

Figure 10:
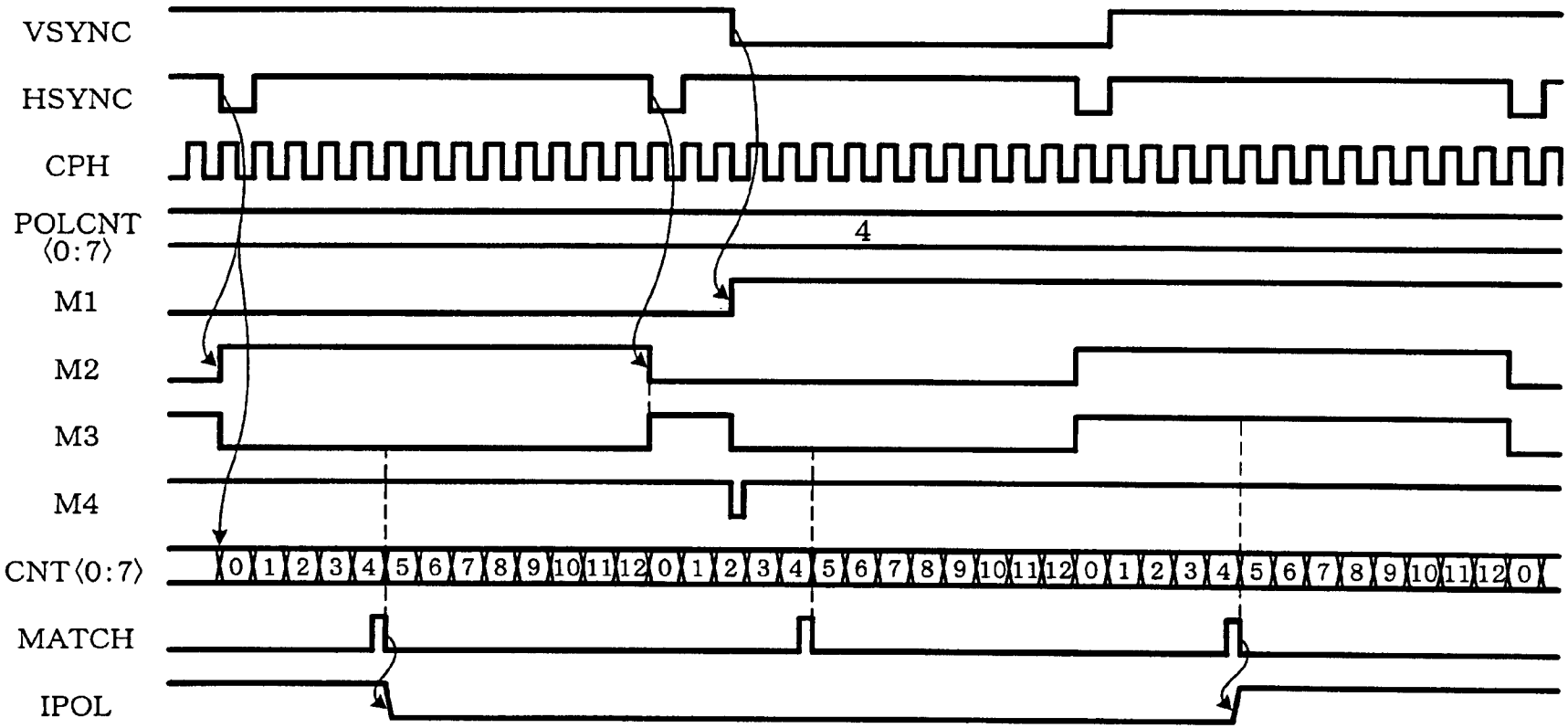
FIG. 10 is an enlarged timing chart showing the change point of a vertical synchronization signal in FIG. 9.

FIG. 10 is an enlarged timing chart showing the change point of the vertical synchronization signal VSYNC in FIG. 9.

When the POL output counter 114 is initialized in synchronization with the falling edge of the horizontal synchronization signal HSYNC as shown in FIG. 8, the POL output counter 114 increments the counter value CNT<0:7> in synchronization with the rising edge of the dot clock signal CPH. When the counter value CNT<0:7> becomes four, the coincidence signal MATCH is output as a pulse at the H level. The DFF1-1 fetches the output signal M3 based on the coincidence signal MATCH. As a result, the change of the polarity reversal signal IPOL is delayed for a period corresponding to four dot clock signals CPH.

As described above, the polarity reversal signal generation circuit 110 can generate the polarity reversal signal IPOL which can adjust the output timing by delaying a signal generated based on the horizontal synchronization signal HSYNC and the vertical synchronization signal VSYNC.

The effects described below can be obtained by the display driver 100 including the polarity reversal signal generation circuit 110 in comparison with a comparative example given below.

Figure 11:
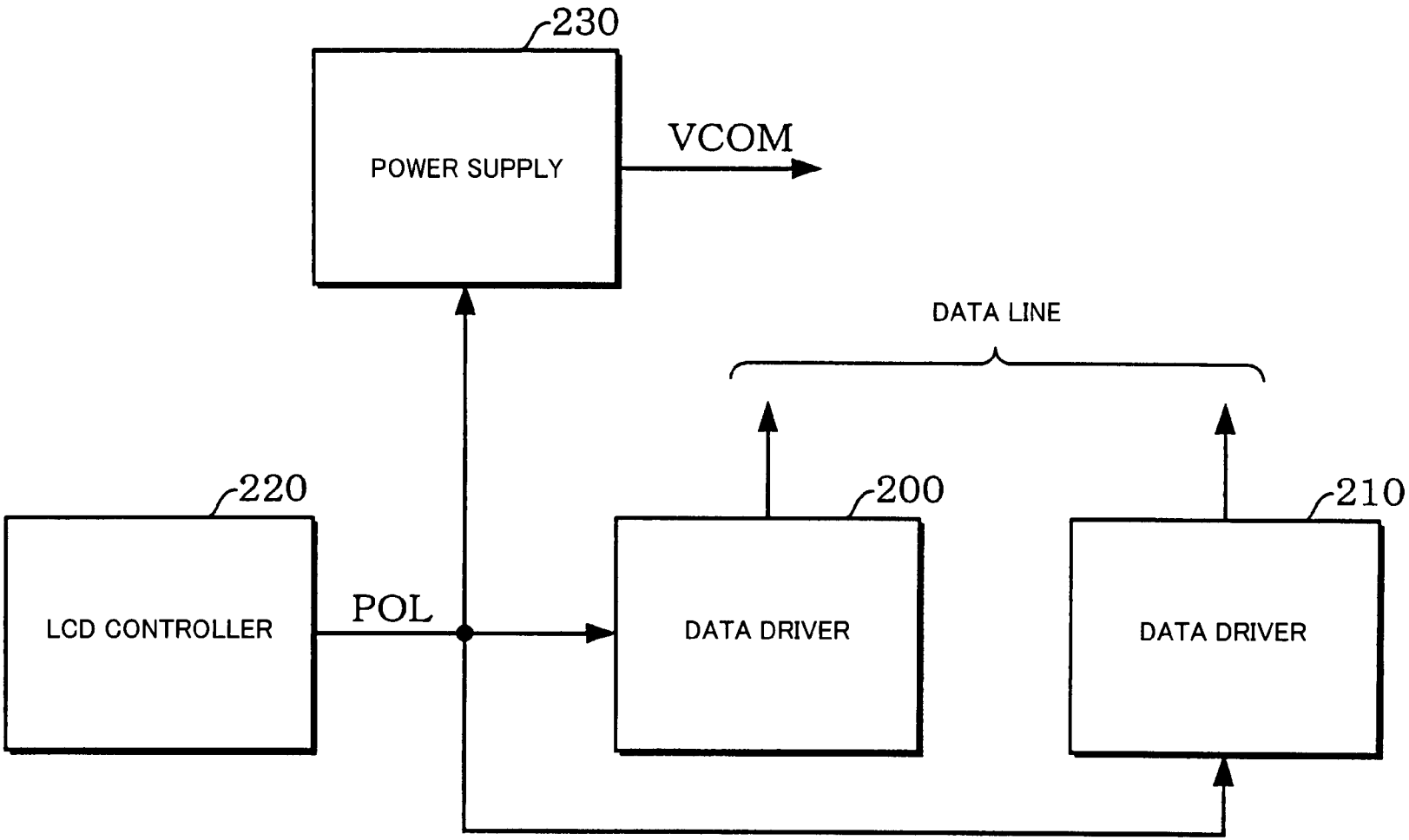
FIG. 11 is a block diagram showing main components of a liquid crystal device according to a comparative example.

FIG. 11 shows main components of a liquid crystal device according to a comparative example of this embodiment.

In this comparative example, the data line of the LCD panel of the liquid crystal device is driven by two data drivers 200 and 210. An LCD controller 220 generates the polarity reversal signal POL, and supplies the polarity reversal signal POL to the data drivers 200 and 210 and a power supply circuit 230. The data drivers 200 and 210 receive the polarity reversal signal POL from the LCD controller 220. The data drivers 200 and 210 perform a polarity reversal drive based on the received polarity reversal signal POL. The power supply circuit 230 changes the common electrode voltage VCOM based on the polarity reversal signal POL.

If the common electrode voltage VCOM and the drive voltage are changed using the single polarity reversal signal POL irrespective of the difference between the charging/discharging time of the common electrode voltage VCOM and the charging/discharging time of the data line, a difference in timing occurs, whereby the display quality of the LCD panel may deteriorate. Moreover, it is difficult to provide an interconnect for the polarity reversal signal POL due to the interconnect region for the bus for supplying the display data to the data driver, and the change timing of the polarity reversal signal POL received by the data drivers 200 and 210 differs due to the load capacitance of the interconnect and the like.

On the other hand, the data driver to which the display driver according to this embodiment is applied can internally generate the polarity reversal signal and adjust the output timing of the polarity reversal signal. Therefore, the output timing of the polarity reversal signal can be allowed to coincide with the change timing of the common electrode voltage VCOM supplied by the power supply circuit. Therefore, an input terminal of the data driver for the polarity reversal signal can be reduced, and deterioration of the display quality can be reduced by eliminating the difference in the polarity reversal timing.

2. Configuration Example

A case of driving an LCD panel formed by a low temperature poly-silicon (hereinafter abbreviated as "LTPS") process using two data drivers to which the display driver according to this embodiment is applied is described below. The following description illustrates the case of using two data drivers. However, the same description applies to the case of using three or more data drivers.

According to the LTPS process, a driver circuit and the like can be directly formed on a panel substrate (glass substrate, for example) on which a pixel including a TFT and the like is formed. Therefore, the number of parts can be reduced, whereby the size and weight of the display panel can be reduced. Moreover, LTPS enables the pixel size to be reduced while maintaining the aperture ratio by applying a conventional silicon process technology. Furthermore, LTPS has a high charge mobility and a small parasitic capacitance in comparison with amorphous silicon (a-Si). Therefore, a charging period of the pixel formed on the substrate can be secured even if the pixel select period for one pixel is reduced due to an increase in the screen size, whereby the image quality can be improved.

Figure 12:
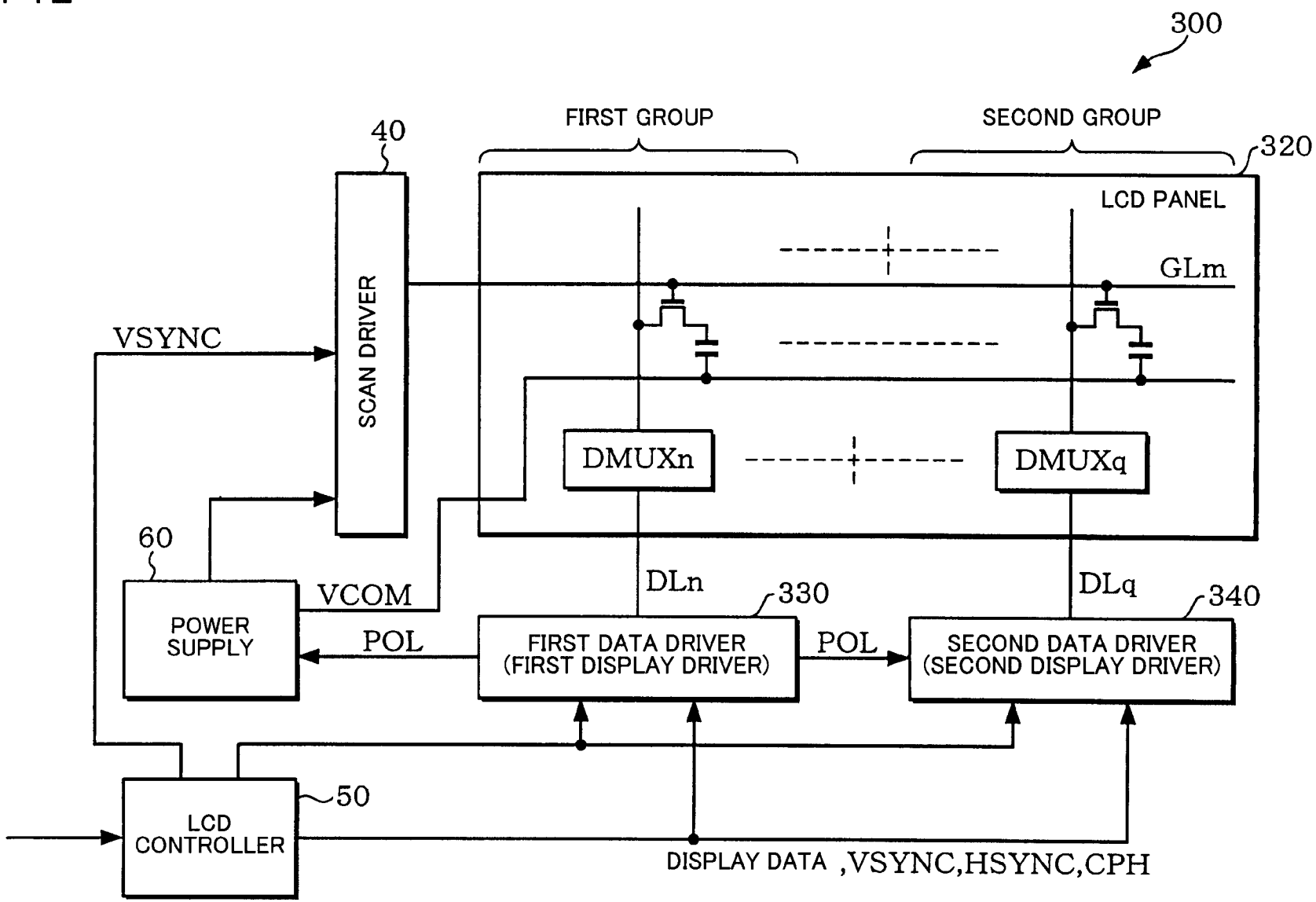
FIG. 12 is a block diagram showing a liquid crystal device including an LCD panel formed by an LTPS process.

FIG. 12 shows a liquid crystal device including an LCD panel formed by the LTPS process. Note that components corresponding to those in the liquid crystal device of FIG. 1 are denoted by the same reference numbers and further description thereof is omitted.

A liquid crystal device 300 includes an LCD panel 320 formed by the LTPS process. A first group of data lines of the LCD panel 320 is driven by a first data driver 330. A second group of data lines of the LCD panel 320 is driven by a second data driver 340.

In the case where the LCD panel 320 includes data lines DL1 to DL(2N), the first group may consist of the data lines DL1, . . . DLn . . . , and DLN, and the second group may consist of the data lines DL(N+1), . . . DLq . . . , and DL(2N) ($N+1 \leqq q \leqq 2N$; q is a positive integer).

The first and second data drivers 330 and 340 have the function of the display driver 100, and are set to a master mode or a slave mode. In FIG. 12, the first data driver 330 is set in the master mode, and the second data driver 340 is set in the slave mode.

The first data driver 330 generates the polarity reversal signal IPOL using the above-described polarity reversal signal generation circuit, performs a polarity reversal drive based on the polarity reversal signal IPOL, and supplies the polarity reversal signal IPOL to the second data driver 340 as the polarity reversal signal POL. The second data driver 340 performs a polarity reversal drive based on the polarity reversal signal POL supplied from the first data driver 330.

The first data driver 330 also supplies the polarity reversal signal IPOL to the power supply circuit 60 as the polarity reversal signal POL. The power supply circuit 60 changes the common electrode voltage VCOM in synchronization with the polarity reversal signal POL.

According to this configuration, the change timings of the pixel electrodes to which the drive voltages supplied from the first and second groups of data lines are applied can be allowed to coincide with high accuracy. Therefore, deterioration of the display quality caused by the difference in polarity reversal timing can be reduced in the display region including the first group of data lines and the display region including the second group of data lines of the LCD panel 320.

Figure 13:
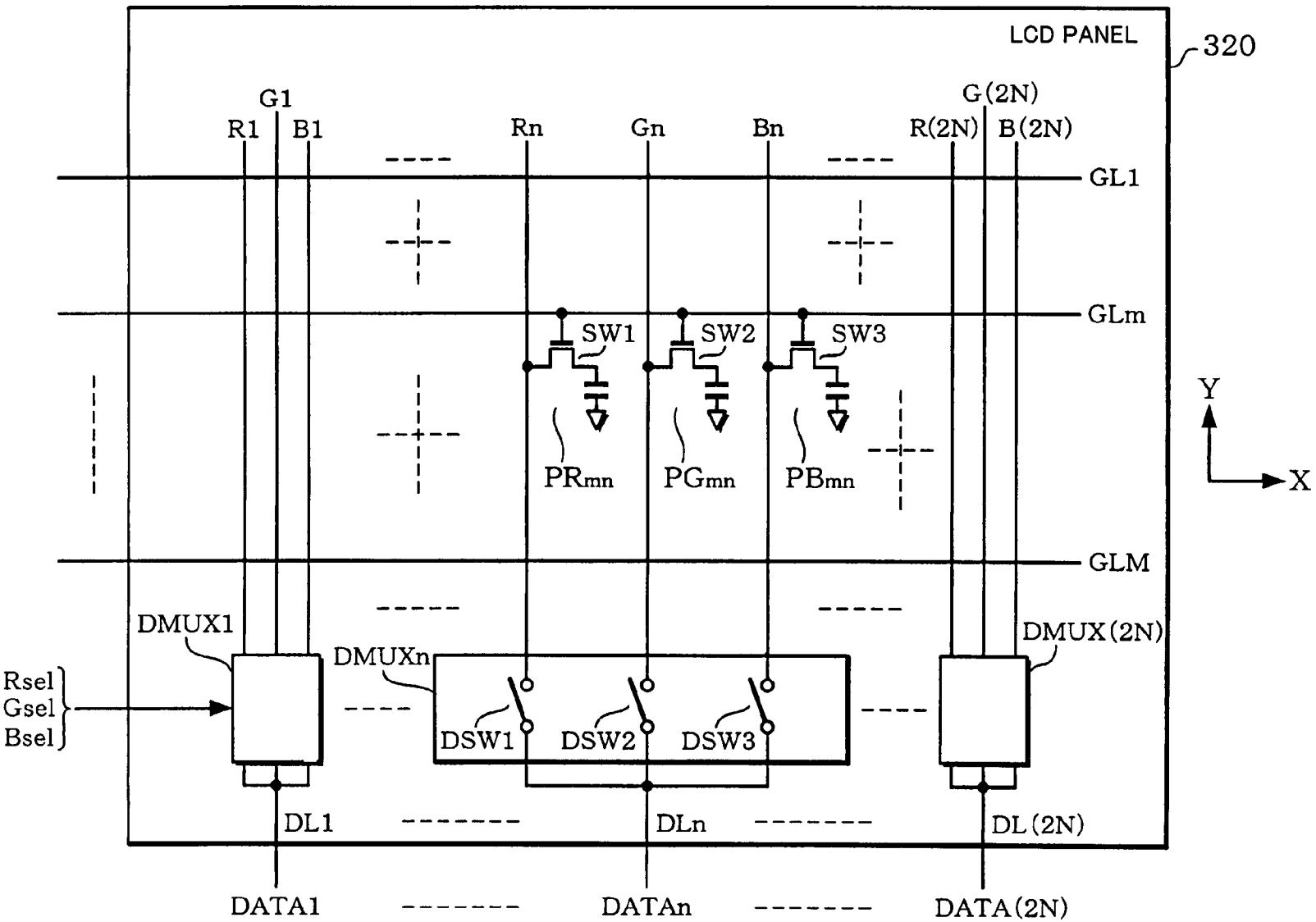
FIG. 13 is a diagram schematically showing an LCD panel formed by an LTPS process.

FIG. 13 schematically shows the LCD panel formed by the LTPS process.

The LCD panel 320 includes a plurality of scan lines, a plurality of color component switching elements (TFT), each of the color component switching elements being connected with one of the scan lines, a plurality of pixel electrodes, each of the pixel electrodes being connected with one of the color component switching elements, and a plurality of data lines through which first to third color component data signals are transmitted in a multiplexed state. The LCD panel 320 further includes a plurality of demultiplexers, each of the demultiplexers including first to third demultiplex switching elements which are switch-controlled based on first to third demultiplex control signals, one end of each of the demultiplex switching elements being connected with one of the data lines and the other end being connected with one of the color component switching elements, and a common electrode which faces the pixel electrodes through an electro-optical substance.

In the LCD panel 320, a plurality of scan lines GL1 to GLM, arranged in the Y direction and extending in the X direction, and a plurality of data lines DL1 to DL(2N), arranged in the X direction and extending in the Y direction, are formed on a panel substrate. A plurality of sets of first to third color component data lines (R1, G1, B1) to (R(2N), G(2N), B(2N)), arranged in the X direction and extending in the Y direction, are formed on the panel substrate.

R pixels (first color component pixels) PR(PR11 to PRM(2N)) are formed at the intersecting points of the scan lines GL1 to GLM and the first color component data lines R1 to R(2N). G pixels (second color component pixels) PG(PG11 to PGM(2N)) are formed at the intersecting points of the scan lines GL1 to GLM and the second color component data lines G1 to G(2N). B pixels (third color component pixels) PB(PB11 to PBM(2N)) are formed at the intersecting points of the scan lines GL1 to GLM and the third color component data lines B1 to B(2N).

Demultiplexers DMUX1 to DMUX(2N) are provided on the panel substrate corresponding to the data lines. The demultiplexers DMUX1 to DMUX(2N) are switch-controlled by demultiplex control signals Rsel, Gsel, and Bsel.

Figure 14:
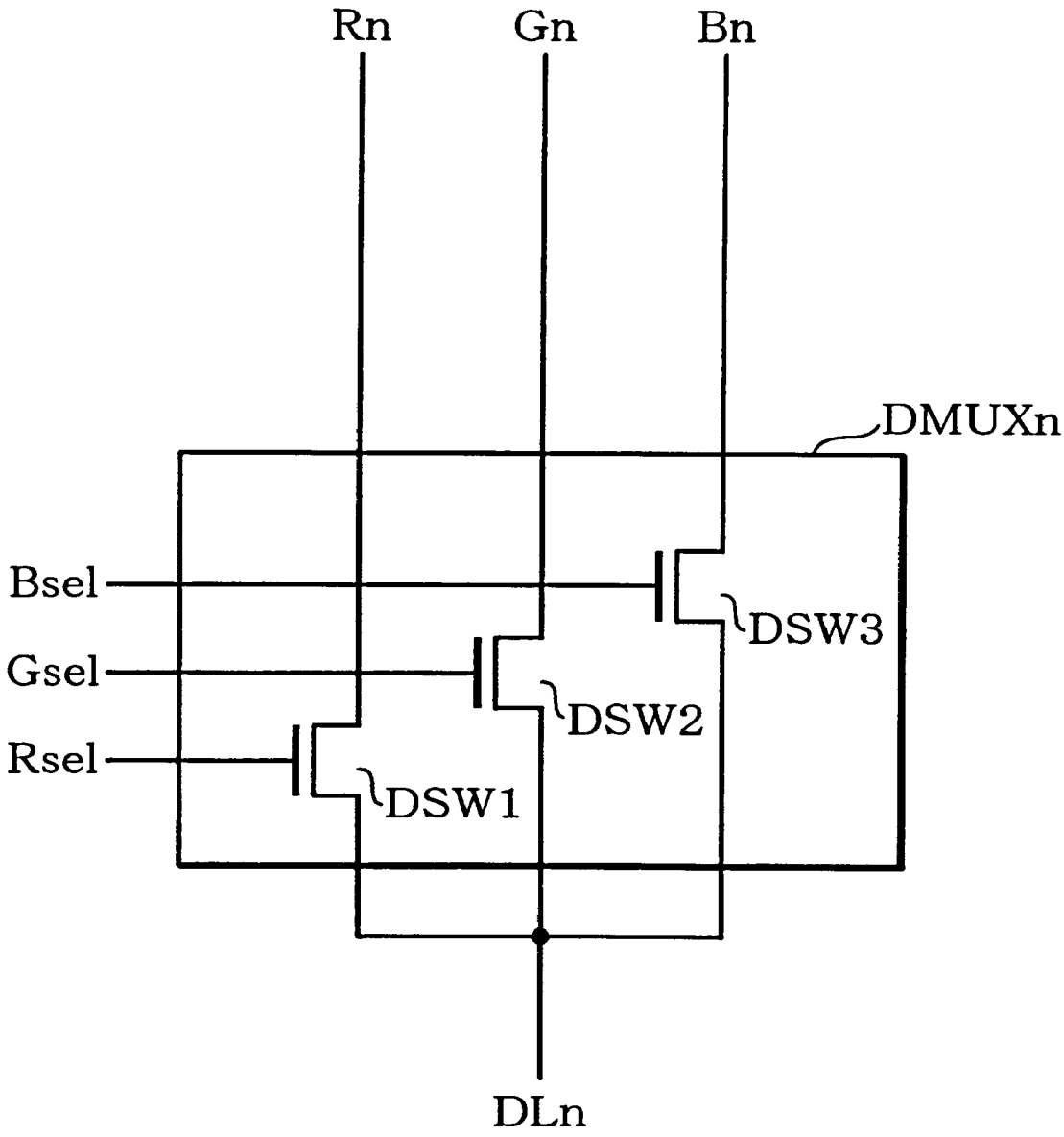
FIG. 14 is a diagram schematically showing the demultiplexer of FIG. 13.

FIG. 14 schematically shows the demultiplexer DMUXn. The following description is given taking the demultiplexer DMUXn as an example. However, other demultiplexers have the same configuration as that of the demultiplexer DMUXn.

The demultiplexer DMUXn includes first to third demultiplex switching elements DSW1 to DSW3.

The first to third color component data lines (Rn, Gn, Bn) are connected with the output of the demultiplexer DMUXn. The data line DLn is connected with the input of the demultiplexer DMUXn. The demultiplexer DMUXn electrically connects the data line DLn with one of the first to third color component data lines (Rn, Gn, Bn) in response to the demultiplex control signals Rsel, Gsel, and Bsel. The demultiplex control signals are input in common to the demultiplexers DMUX1 to DMUX(2N).

Figure 15:
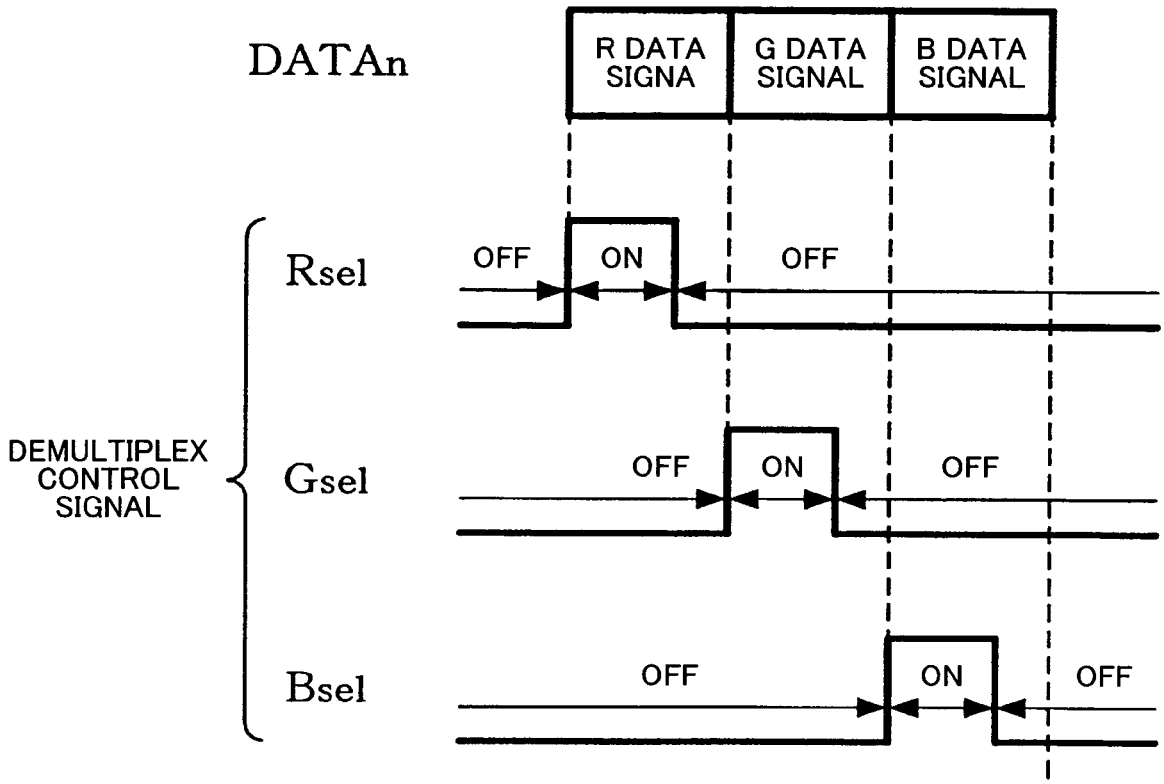
FIG. 15 is a diagram for illustrating a demultiplex control signal.

The demultiplex control signals Rsel, Gsel, and Bsel are supplied from at least one of the first and second data drivers 330 and 340, for example. In this case, each of the first and second data drivers 330 and 340 outputs voltages (data signals or color component data), which are time-divided in units of color component pixels and correspond to the color component data signals, to the data line DLn, as shown in FIG. 15. At least one of the first and second data drivers 330 and 340 generates the demultiplex control signals Rsel, Gsel, and Bsel for selectively outputting the voltage based on the color component data to the color component data line in synchronization with the time-division timing, and outputs the demultiplex control signals to the LCD panel 320.

Figure 16:
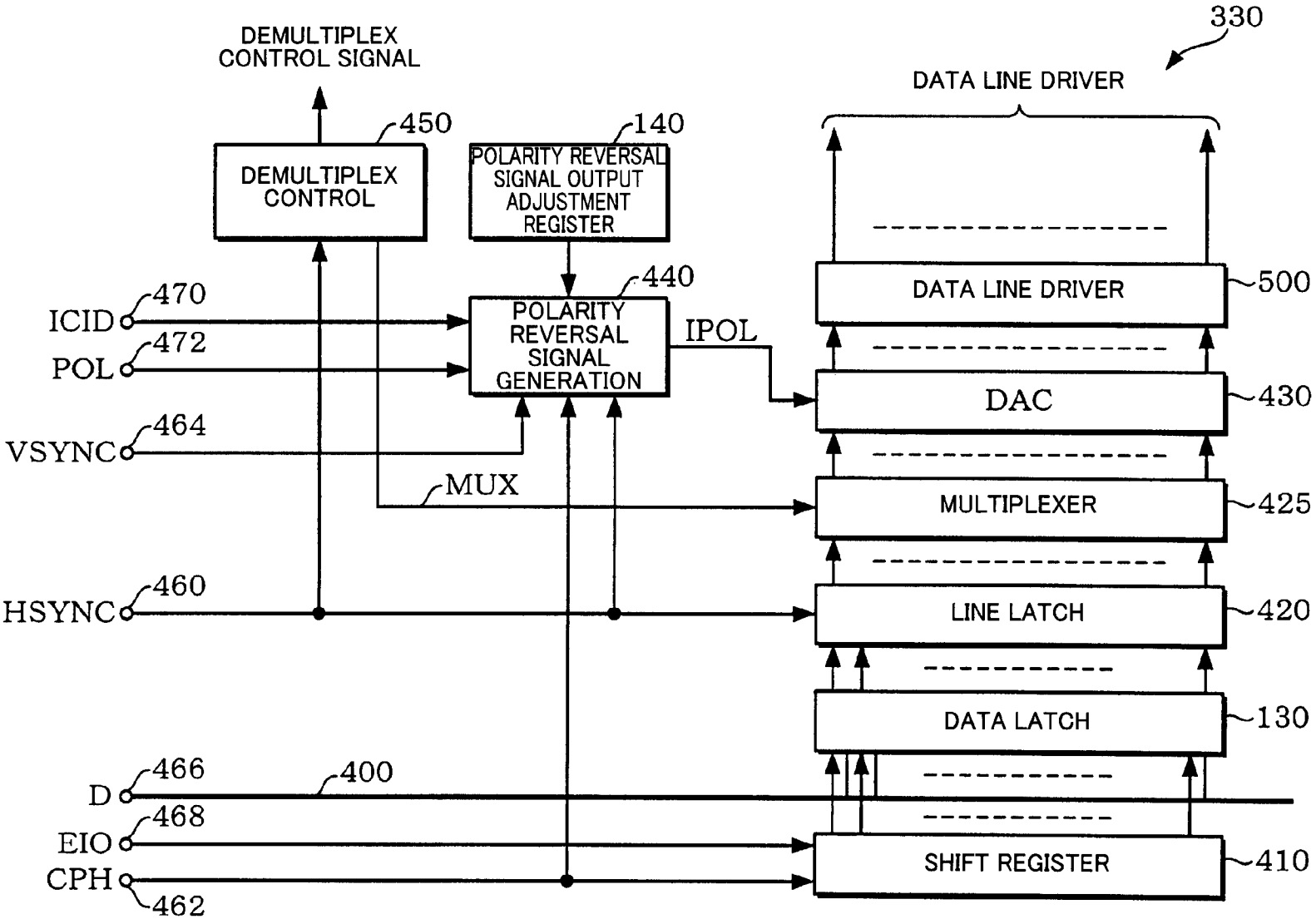
FIG. 16 is a block diagram showing main components of the first data driver shown in FIG. 12.

FIG. 16 shows a block diagram showing main components of the first data driver 330. Note that components corresponding to those of the display driver 100 of FIG. 2 are denoted by the same reference numbers and further description thereof is omitted. The following description illustrates the configuration of the first data driver 330. However, the second data driver 340 has the same configuration as that of the first data driver 330.

The data driver 330 includes a display data bus 400, a shift register 410, a data latch 130, a line latch 420, a multiplexer circuit 425, a digital-to-analog converter (DAC) 430 (voltage select circuit in a broad sense), a data line driver circuit 500, a polarity reversal signal generation circuit 440, the polarity reversal signal output adjustment register 140, and a demultiplex control circuit 450. The DAC 430 and the data line driver circuit 500 correspond to the driver section 120 shown in FIG. 2, for example.

The demultiplex control circuit 450 generates a multiplex control signal MUX for performing time-division multiplexing in the multiplexer circuit 425. As a result, the multiplexer circuit 425 generates a signal in which the first to third color component data signals are multiplexed as shown in FIG. 15. The demultiplex control circuit 450 supplies the demultiplex control signals Rsel, Gsel, and Bsel to the demultiplexers DMUX1 to DMUX(2N) of the LCD panel 320 in synchronization with the multiplex timing of the first to third color component data signals shown in FIG. 15.

The data driver 330 may include a horizontal synchronization signal input terminal 460 to which the horizontal synchronization signal HSYNC is input, a dot clock signal input terminal 462 to which the dot clock signal CPH is input, a vertical synchronization signal input terminal 464 to which the vertical synchronization signal VSYNC is input, a display data input terminal 466 to which the display data is input in synchronization with the dot clock signal CPH in units of R, G, and B display data, six bits each, and an enable input/output signal input terminal 468 to which an enable input/output signal EIO is input. The horizontal synchronization signal HSYNC, the vertical synchronization signal VSYNC, the dot clock signal CPH, the display data, and the enable input/output signal EIO are supplied from the LCD controller 50 (not shown).

The data driver 330 may include a mode setting input terminal 470 to which a mode setting signal ICID is input, and a polarity reversal signal input/output terminal 472 to or from which the polarity reversal signal POL is input or output. The mode setting signal ICID is a signal for setting the data driver 330 to the master mode or the slave mode. The mode setting signal ICID is supplied from the LCD controller 50 or generated by a pull-up circuit or a pull-down circuit.

FIG. 17 shows functions of the mode setting signal ICID.

When the mode setting signal ICID is set at the L level (when a first voltage is supplied to the mode setting input terminal 470), the data driver 330 is set to the master mode. In the master mode, the data driver 330 outputs a polarity reversal signal IPOL1 generated by the polarity reversal signal generation circuit 440 to the outside as the polarity reversal signal POL through the polarity reversal signal input/output terminal 472.

When the mode setting signal ICID is set at the H level (when a second voltage is supplied to the mode setting input terminal 470), the data driver 330 is set to the slave mode. In the slave mode, the data driver 330 performs a polarity reversal drive based on the polarity reversal signal input from the outside through the polarity reversal signal input/output terminal 472.

Figure 18:
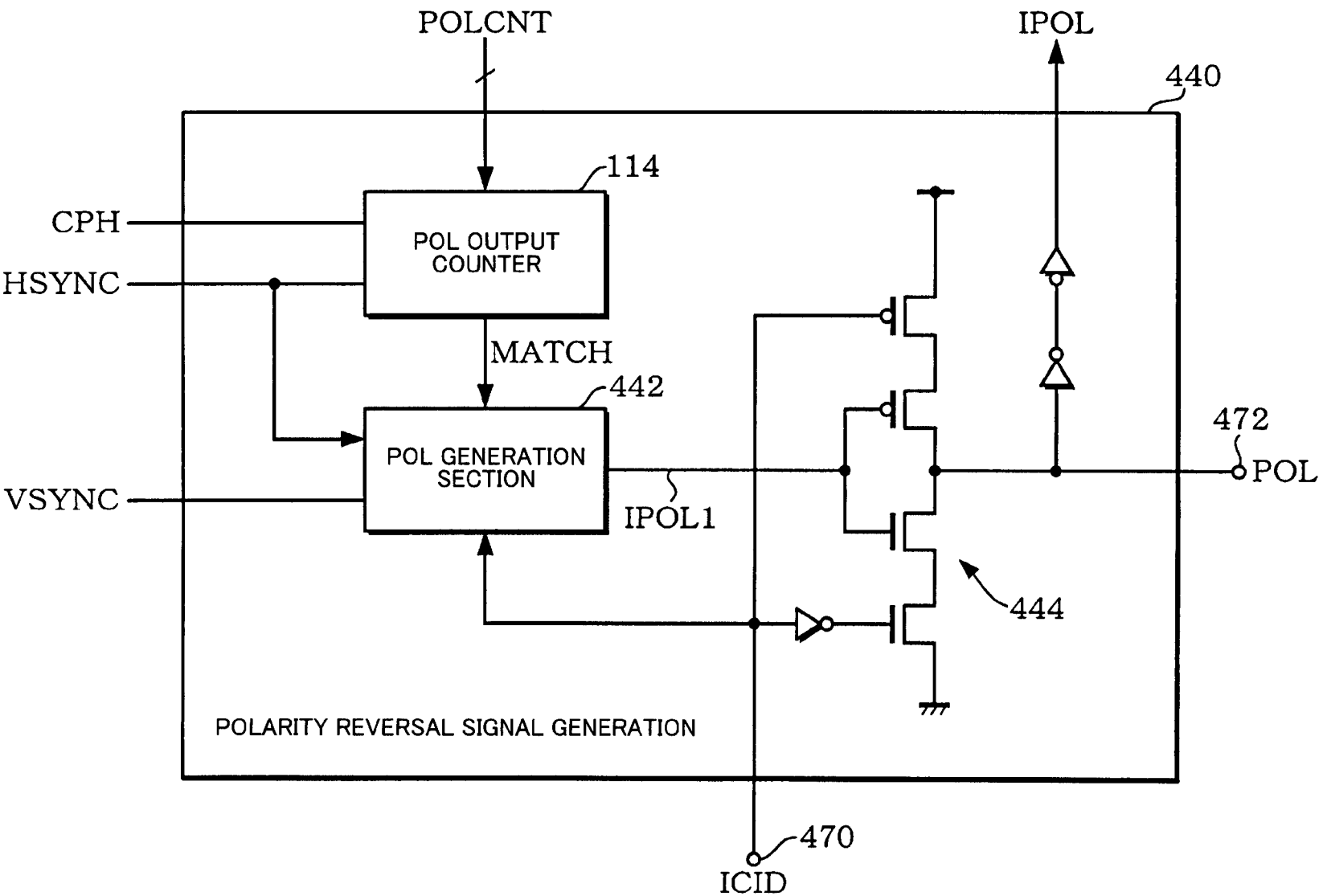
FIG. 18 is a block diagram schematically showing the polarity reversal signal generation circuit shown in FIG. 16.

FIG. 18 schematically shows the polarity reversal signal generation circuit 440. In FIG. 18, sections the same as the sections of the polarity reversal signal generation circuit 110 shown in FIG. 6 are denoted by the same symbols. Description of these sections is appropriately omitted.

The polarity reversal signal generation circuit 440 mainly differs from the polarity reversal signal generation circuit 110 shown in FIG. 6 in that the polarity reversal signal generation circuit 440 includes a POL generation section 442 and an output buffer 444. The POL generation section 442 is configured not to perform an unnecessary operation by mask control using the mode setting signal ICID. The output buffer 444 allows the signal input through the polarity reversal signal input/output terminal 472 to be output to the DAC 430 (driver section in a broad sense) as the polarity reversal signal IPOL corresponding to the mode setting signal ICID.

Figure 19:
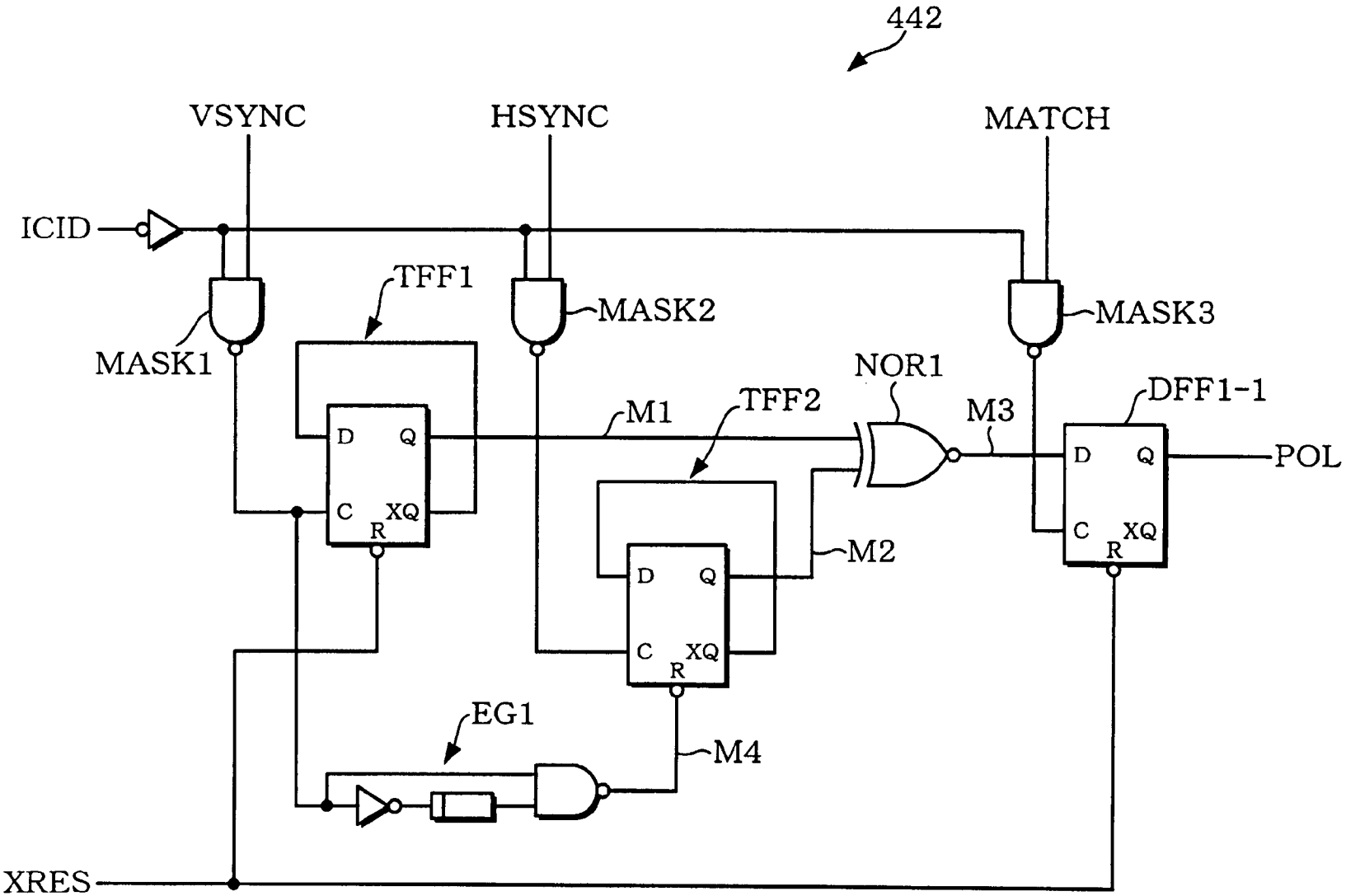
FIG. 19 is a circuit diagram showing the POL generation section of FIG. 18.

FIG. 19 is a circuit diagram showing the POL generation section 442 shown in FIG. 18. Note that components corresponding to those of the POL generation section 112 of FIG. 7 are denoted by the same reference numbers and further description thereof is omitted.

The POL generation section 442 includes mask circuits MASK1, MASK2, and MASK3 for mask-controlling the operations of the TFF1, TFF2, and DFF1-1 by the mode setting signal ICID. The mask circuits MASK1, MASK2, and MASK3 perform the operation described with reference to FIG. 7 in the master mode (when the mode setting signal ICID is set at the L level).

In the slave mode (when the mode setting signal ICID is set at the H level), the mask circuit MASK1 performs mask-control so that the output of the TFF1 does not change even if the vertical synchronization signal VSYNC changes. In the slave mode, the mask circuit MASK2 performs mask-control so that the output of the TFF2 does not change even if the horizontal synchronization signal HSYNC changes. In the slave mode, the mask circuit MASK3 performs mask-control so that the output of the DFF1-1 does not change even if the coincidence signal MATCH changes.

In FIG. 18, in the master mode (when the mode setting signal ICID is set at the L level), the polarity reversal signal IPOL1 output from the POL generation section 442 is output from the polarity reversal signal input/output terminal 472 through the output buffer 444, and output to the driver section (DAC 430 in FIG. 16) as the polarity reversal signal IPOL.

In the slave mode (when the mode setting signal ICID is set at the H level), the output of the output buffer 444 is set in a high impedance state. Therefore, the signal input through the polarity reversal signal input/output terminal 472 is output to the driver section (DAC 430 in FIG. 16) as the polarity reversal signal IPOL.

Each section of the data driver 330 which performs a polarity reversal drive based on the polarity reversal signal IPOL generated in this manner is described below.

Figure 20:
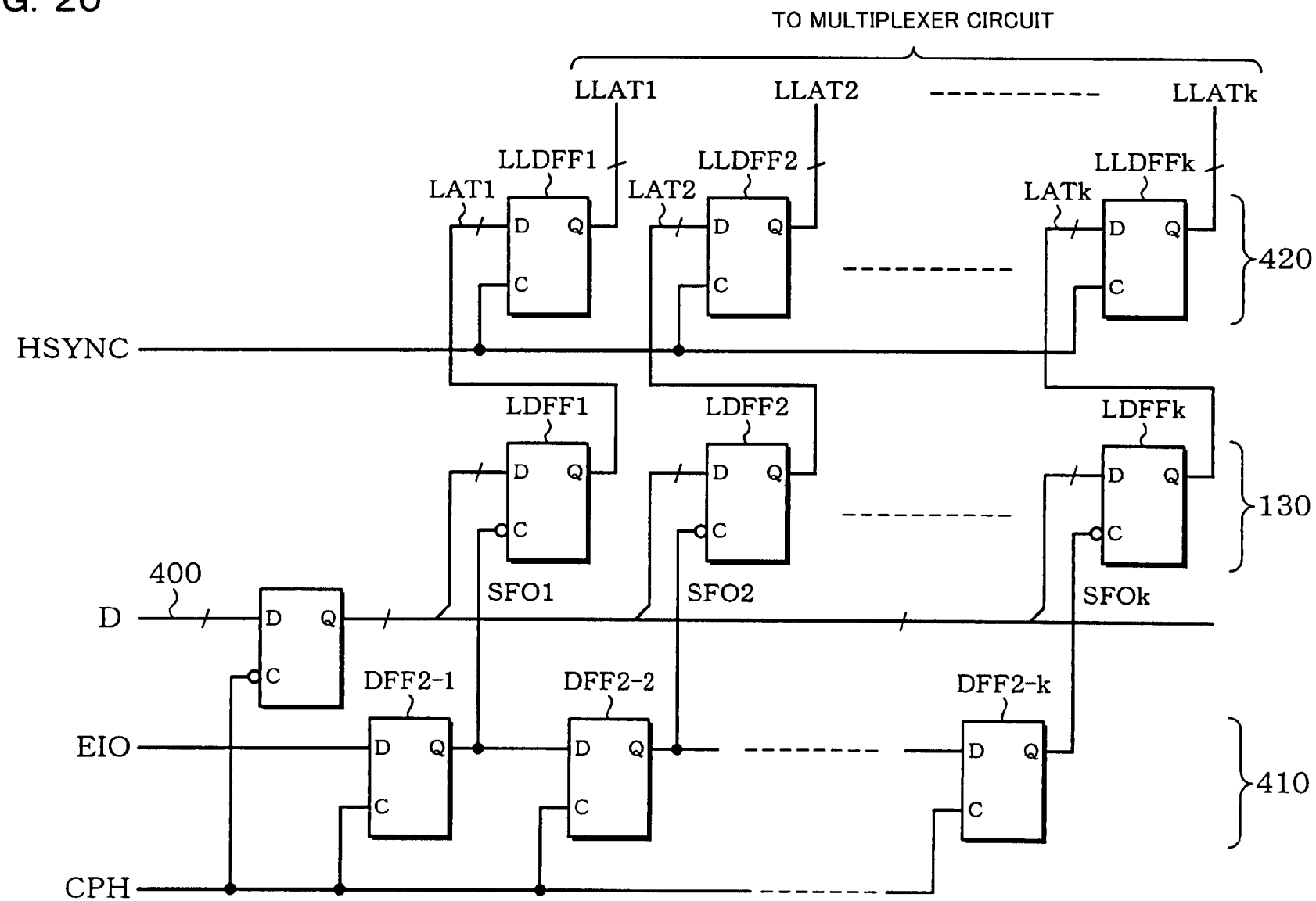
FIG. 20 is a circuit diagram showing the shift register, data latch, and line latch shown in FIG. 16.

FIG. 20 shows the shift register 410, the data latch 130, and the line latch 420.

The shift register 410 includes first to kth D flip-flops DFF2-1 to DFF2-k. In the following description, the ith D flip-flop is denoted as the D flip-flop DFF2-i ($1 \leqq i \leqq k$; k and i are integers). The shift register 410 is formed by connecting the D flip-flops DFF2-1 to DFF2-k in series. Specifically, the data output terminal Q of the D flip-flop DFF2-j ($1 \leqq j \leqq k-1$; k and j are integers) is connected with the data input terminal D of the D flip-flop DFF2-(j+1) in the subsequent stage.

Shift outputs SFO1 to SFOk are output from the data output terminals Q of the D flip-flops DFF2-1 to DFF2-k. The enable input/output signal EIO is input to the data input terminal D of the D flip-flop DFF2-1. The dot clock signal CPH is input in common to clock input terminals C of the D flip-flops DFF2-1 to DFF2-k.

The data latch 130 includes first to kth latch D flip-flops. In the following description, the ith latch D flip-flop ($1 \leqq i \leqq k$; k and i are integers) is denoted as the D flip-flop LDFFi. The D flip-flop LDFFi retains a signal input to a data input terminal D at the falling edge of a signal input to a clock input terminal C. The D flip-flop LDFFi retains the display data for the number of bits of the bus width of the display data bus 400. The bus width of the display data bus 400 is the sum of the number of bits "6" of the first color component (R) display data, the number of bits "6" of the second color component (G) display data, and the number of bits "6" of the third color component (B) display data. The shift output SFOi from the shift register 410 is supplied to the clock input terminal C of the D flip-flop LDFFi. Latch data LATi is data from the data output terminal Q of the D flip-flop LDFFi. Input synchronization data generated by synchronizing the display data on the display data bus 400 with the falling edge of the dot clock signal CPH is input in common to the data input terminals D of the D flip-flops LDFF1 to LDFFk.

The line latch 420 includes first to kth line latch D flip-flops. In the following description, the ith line latch D flip-flop ($1 \leqq i \leqq k$; k and i are integers) is denoted as the D flip-flop LLDFFi. The D flip-flop LLDFFi retains the display data for the number of bits of the bus width of the display data bus 400. The horizontal synchronization signal HSYNC is supplied to a clock input terminal C of the D flip-flop LLDFFi. Line latch data LLATi is data from a data output terminal Q of the D flip-flop LLDFFi. The data output terminal Q of the D flip-flop LDFFi is connected with a data input terminal D of the D flip-flop LLDFFi.

The D flip-flops DFF1-1 to DFF1-k, LDFF1 to LDFFk, and LLDFF1 to LLDFFk are initialized by the inversion reset signal XRES.

Figure 21:
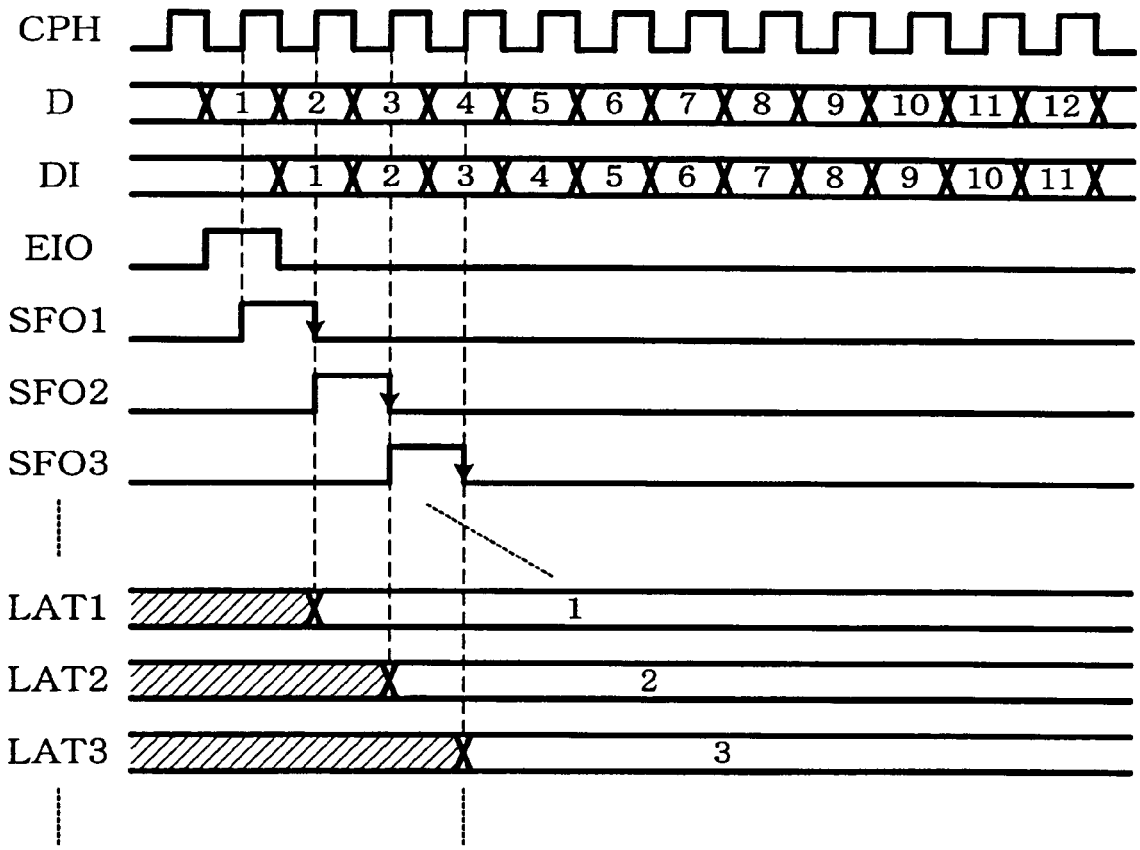
FIG. 21 is a timing chart showing an operation example of the shift register and data latch shown in FIG. 20.

FIG. 21 is a timing chart showing an operation example of the shift register 410 and the data latch 130.

The display data is sequentially supplied to the display data bus 400 in synchronization with the dot clock signal CPH in units of the first color component (R) display data, the second color component (G) display data, and the third color component (B) display data. The enable input/output signal EIO is set at the H level corresponding to the head position of the display data.

The shift register 410 performs the shift operation of the enable input/output signal EIO. Specifically, the shift register 410 fetches the enable input/output signal EIO at the rising edge of the dot clock signal CPH. The shift register 410 sequentially outputs a pulse shifted in synchronization with the rising edge of the dot clock signal CPH as the shift outputs SFO1 to SFOk in each stage.

The data latch 130 fetches the input synchronization data as the display data at the falling edge of the shift output in each stage of the shift register 410. As a result, the data latch 130 fetches the display data in the order of the D flip-flops LDFF1, LDFF2, . . . . The display data fetched into the D flip-flops LDFF1 to LDFFk is respectively output as the latch data LAT1 to LATk.

The line latch 420 latches the display data fetched into the data latch 130 in units of one horizontal scan period. The display data for one horizontal scan latched by the line latch 420 is supplied to the multiplexer circuit 425.

Figure 22A:
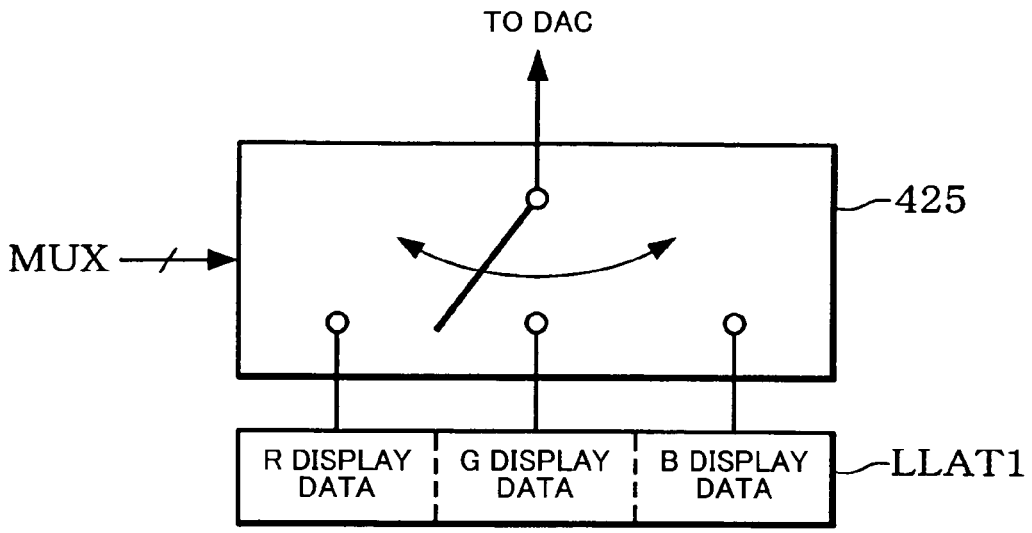
FIGS. 22A and 22B are diagrams for illustrating a multiplexer circuit.
Figure 22B:
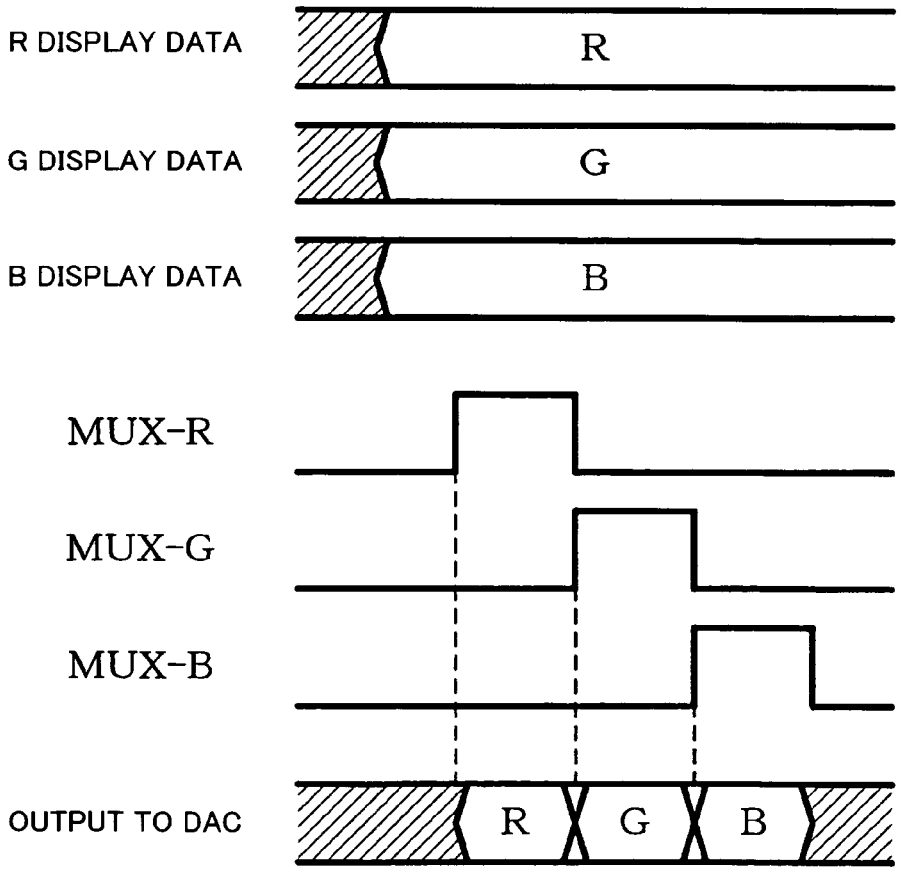

FIGS. 22A and 22B are diagrams for illustrating the multiplexer circuit 425. FIG. 22A schematically shows the configuration of the multiplexer circuit 425. FIG. 22B is a timing chart of an operation example of the multiplexer circuit 425.

FIG. 22A shows an example in which the multiplexer circuit 425 multiplexes the line latch data LLAT1. However, the multiplexer circuit 425 can multiplex other pieces of line latch data in the same manner as the line latch data LLAT1.

The D flip-flop LLDFF1 retains the first color component (R) display data, the second color component (G) display data, and the third color component (B) display data as the line latch data LLAT1, as described above. The multiplexer circuit 425 sequentially reads and outputs the first color component (R) display data, the second color component (G) display data, and the third color component (B) display data by the multiplex control signal MUX.

For example, the multiplex control signal MUX includes an R display data read control signal MUX-R, a G display data read control signal MUX-G, and a B display data read control signal MUX-B, and these read control signals are sequentially activated within one horizontal scan period.

Therefore, the change timings of the R display data read control signal MUX-R, the G display data read control signal MUX-G, and the B display data read control signal MUX-B may be determined in association with the change timings of the demultiplex control signals Rsel, Gsel, and Bsel shown in FIG. 15. For example, the demultiplex control signals Rsel, Gsel, and Bsel shown in FIG. 15 may be respectively used as the R display data read control signal MUX-R, the G display data read control signal MUX-G, and the B display data read control signal MUX-B.

Figure 23:
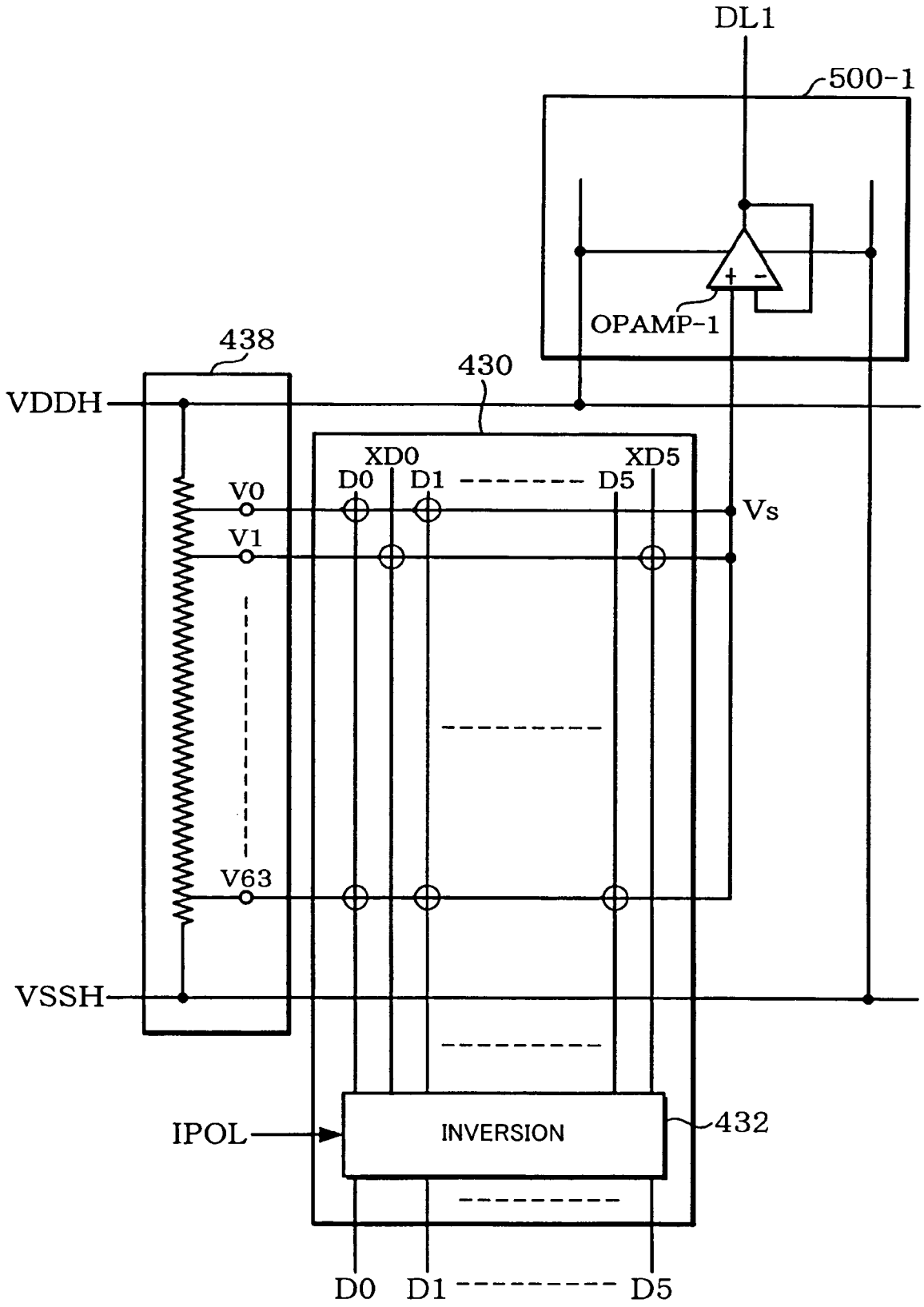
FIG. 23 is a circuit diagram showing a data output section in a DAC and a data line driver section.

FIG. 23 is a circuit diagram showing a data output section in the DAC 430 and the data line driver section 502. Only the configuration for one output of the data line DL1 is shown in this figure.

The DAC 430 selects a drive voltage based on the display data from reference voltages generated by a reference voltage generation circuit 438, and outputs the selected drive voltage. The reference voltage generation circuit 438 includes a resistor circuit inserted between two power supply lines to which high-potential-side and low-potential-side power supply voltages are supplied, and generates the reference voltages by dividing the voltage between the two power supply lines using the resistor circuit.

The DAC 430 may be realized by a read only memory (ROM) decoder circuit. The DAC 430 selects one of the reference voltages based on the display data multiplexed by the multiplexer circuit 425 (6-bit display data, for example), and outputs the selected reference voltage to the data line driver circuit 500 (data output section 500-1 in FIG. 23) as a select voltage Vs.

In more detail, the DAC 430 includes an inversion circuit 432 which inverts 6-bit display data D0 to D5 based on the polarity reversal signal IPOL. The 6-bit display data input to the inversion circuit 432 is data into which the display data for each color component is time-divided in the multiplexer circuit 425. The inversion circuit 432 performs non-inversion output of each bit of the display data when the polarity reversal signal IPOL is set at a first logical level. The inversion circuit 432 performs inversion output of each bit of the display data when the polarity reversal signal IPOL is set at a second logical level. The output from the inversion circuit 432 is input to a ROM decoder.

The DAC 430 selects one of the reference voltages generated by the reference voltage generation circuit 438 based on the output from the inversion circuit 432. For example, the reference voltage generation circuit 438 generates reference voltages V0 to V63. When the polarity reversal signal IPOL is set at the first logical level, the reference voltage V2 is selected corresponding to the 6-bit display data D5 to D0 "000010" (=2), for example. When the polarity reversal signal POL is set at the second logical level at the next polarity reversal timing, the reference voltage is selected using inverted display data XD to XD0 obtained by reversing each bit of the display data D5 to D0. Specifically, the inverted display data XD5 to XD0 becomes "111101" (=61), whereby the reference voltage V61 is selected. The select voltage Vs selected by the DAC 430 is input to the data output section 500-1. The data line driver section 500 includes data output sections provided in data line units. Each data output section has the same configuration as that of the data output section 500-1.

The data output section 500-1 includes an operational amplifier circuit OPAMP. The operational amplifier circuit OPAMP is a voltage-follower-connected operational amplifier. The operational amplifier circuit OPAMP drives the data line based on the select voltage Vs.

The polarity of a voltage applied to a liquid crystal between the pixel electrode and the common electrode COM which is generated based on the polarity reversal signal IPOL is reversed by driving the data line based on a drive voltage which based on display data which has been non-inversion output or inversion output based on the polarity reversal signal IPOL as described above.

The liquid crystal device described with reference to FIGS. 12 to 23 has the following effects.

The first to third demultiplex switching elements DSW1 to DSW3 of the demultiplexers DMUX1 to DMUX(2N) of the LCD panel 320 may be formed by metal oxide semiconductor (MOS) transistors. However, the charging/discharging time of the common electrode connected with the drain of the MOS transistor is increased as the voltage applied between the source and drain of the MOS transistor is decreased. In the present situation in which the number of gray scales which can be displayed in the liquid crystal device is increased and the voltage width for one grayscale is reduced, if the common electrode is insufficiently charged/discharged, the image quality deteriorates due to an error in the voltage of the common electrode.

Moreover, one horizontal scan period is decreased as the display size of the liquid crystal device is increased. Therefore, it is necessary to reduce the charging/discharging time of the common electrode accompanying the polarity reversal drive. The charging/discharging time of the common electrode is determined depending on the time constant which is the product of the parasitic capacitance Cload of the common electrode and the on-resistance R of the MOS transistor. Therefore, it is necessary to decrease at least one of the parasitic capacitance Cload and the resistance R as the display size is increased. Since the parasitic capacitance Cload of the common electrode cannot be decreased to a large extent, the on-resistance R of the MOS transistor may be decreased. In this case, the resistance R can be decreased by increasing the channel width W of the MOS transistor. However, this increases the scale of the switch circuit. Moreover, self-power consumption of the on-resistance R of the MOS transistor is also increased.

In the case of normally white, if writing of the R data signal is started as shown in FIG. 15 during a period in which the common electrode voltage VCOM changes, the color of the R component becomes deeper. Since the G data signal and the B data signal are written as shown in FIG. 15 after the common electrode voltage VCOM has been completely changed, the entire display image is displayed in red.

In order to solve such problems, it is effective to precharge the data line while performing the above-described polarity reversal drive.

Precharging may be realized by setting the first to third color component data lines (Rn, Gn, Bn) at the same potential before reversing the common electrode voltage VCOM and driving the data line. This may be achieved by making all the first to third demultiplex switching elements DSW1 to DSW3 electrically conductive in the demultiplexers DMUX1 to DMUX(2N).

In order to further increase the precharge effect, it is necessary to change earlier the polarity reversal signal POL which specifies the change timing of the common electrode voltage VCOM for which a sufficient charging/discharging time is necessary. However, as disclosed in Japanese Patent Application Laid-open No. 6-38149, the polarity reversal signal cannot be changed at a timing earlier than the vertical synchronization signal VSYNC and the horizontal synchronization signal HSYNC by merely generating the polarity reversal signal based on the vertical synchronization signal VSYNC and the horizontal synchronization signal HSYNC.

In this embodiment, since the polarity reversal signal generation circuit 440 is provided, the following precharging can be realized.

Figure 24:
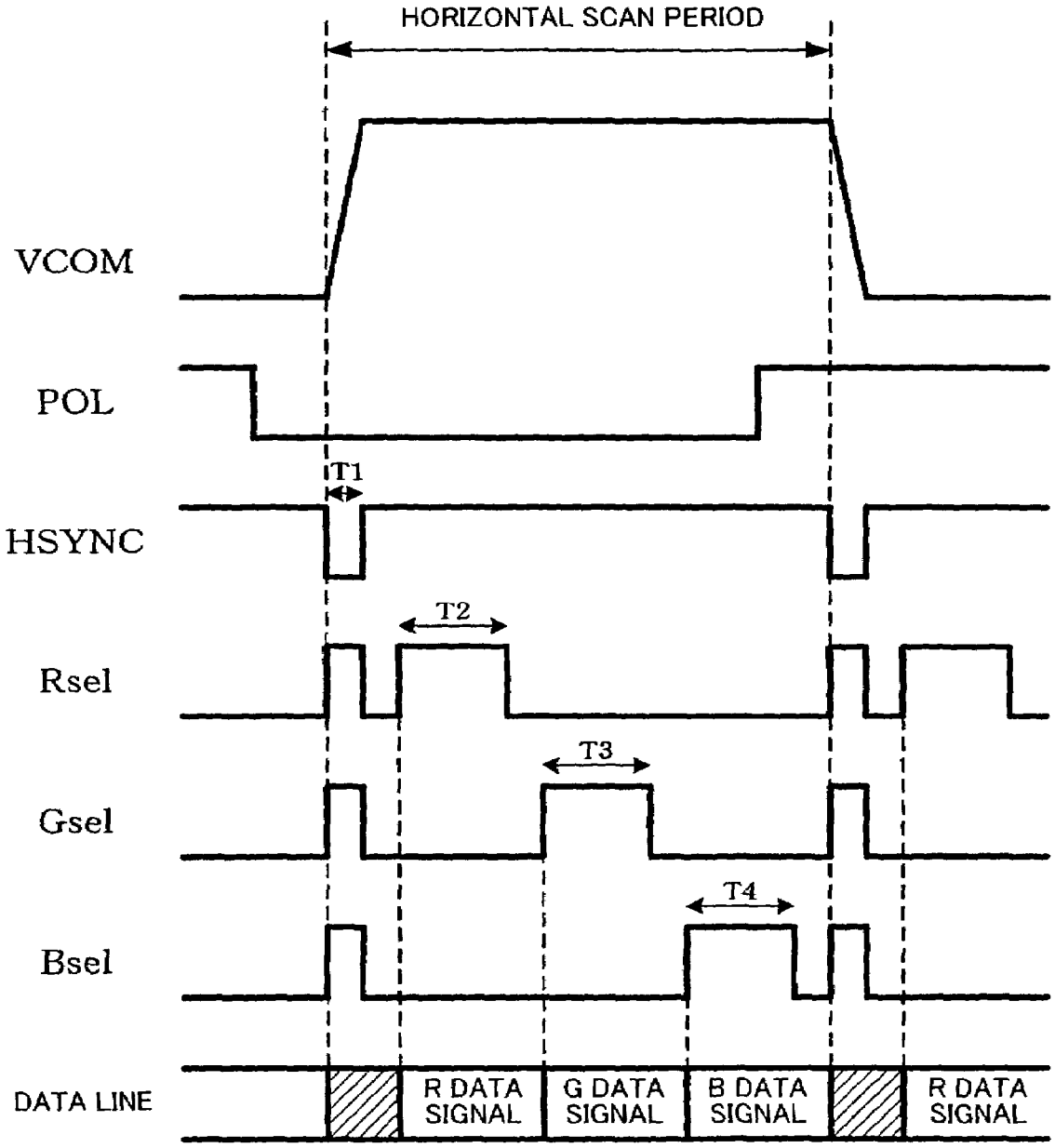
FIG. 24 is a timing chart showing precharge of an LCD panel.

FIG. 24 is a timing chart showing precharging of the LCD panel 320.

The LCD panel 320 includes a scan line, first to third color component switching elements connected with the scan line, first to third pixel electrodes, each of the pixel electrodes being connected with one of the color component switching elements, a data line through which first to third color component data signals are transmitted in a multiplexed state, a plurality of demultiplexers, each of the demultiplexers including first to third demultiplex switching elements which are switch-controlled based on first to third demultiplex control signals, one end of each of the demultiplex switching elements being connected with the data line and the other end being connected with one of the color component switching elements, and a common electrode which faces the first to third pixel electrodes through an electro-optical substance. The LCD panel 320 generates the polarity reversal signal IPOL which changes at a timing earlier than the horizontal synchronization signal HSYNC and the vertical synchronization signal VSYNC.

The following first to fourth steps are performed for the demultiplexers DMUX1 to DMUX(2N) in first to fourth periods T1 to T4 shown in FIG. 24 in a state in which the common electrode voltage VCOM in synchronization with the polarity reversal signal POL is supplied to the common electrode COM.

In the first step, the first to third demultiplex switching elements DSW1 to DSW3 are made electrically conductive by the first to third demultiplex control signals Rsel, Gsel, and Bsel, and the first to third demultiplex switching elements DSW1 to DSW3 are then made non-conductive. This causes the data line and the first to third color component data lines corresponding to the data line to be set at the same potential.

In the second step, only the first demultiplex switching element DSW1 is made electrically conductive for a period in which the drive voltage based on the R (first color component) data signal is supplied to the first demultiplex switching element DSW1.

In the third step, only the second demultiplex switching element DSW2 is made electrically conductive for a period in which the drive voltage based on the G (second color component) data signal is supplied to the second demultiplex switching element DSW2.

In the fourth step, only the third demultiplex switching element DSW3 is made electrically conductive for a period in which the drive voltage based on the B (third color component) data signal is supplied to the third demultiplex switching element DSW3.

In this embodiment, the polarity reversal signal generation circuit 440 can adjust the output timing of the polarity reversal signal POL generated based on the synchronization signals. Therefore, the polarity reversal signal IPOL which changes at a timing earlier than the horizontal synchronization signal HSYNC and the vertical synchronization signal VSYNC can be generated by inverting the polarity reversal signal IPOL or delaying the polarity reversal signal IPOL for about one cycle. Therefore, the speed can be increased by precharging and the polarity reversal timing can be specified with high accuracy, whereby the display quality can be significantly improved.

The present invention is not limited to the above-described embodiments, and various modifications can be made within the scope of the invention. For example, the present invention may be applied not only to drive a liquid crystal display panel, but also to drive an electroluminescent or plasma display device.

Part of requirements of any claim of the present invention could be omitted from a dependent claim which depends on that claim. Moreover, part of requirements of any independent claim of the present invention could be made to depend on any other independent claim.

What is claimed is:

1. A display driver comprising:

a polarity reversal signal generation circuit that generates a polarity reversal signal by delaying a signal based on a horizontal synchronization signal and a vertical synchronization signal; and a driver section that outputs a drive voltage based on display data, a polarity of the drive voltage being reversed in synchronization with the polarity reversal signal, the polarity reversal signal generation circuit including:

an output counter that outputs a coincidence signal when the output counter counts a given number of pulses of a dot clock signal, the output counter starting count of the given number of pulses based on an edge of the horizontal synchronization signal, a first toggle flip-flop that outputs a first output signal, the first output signal changing in synchronization with the vertical synchronization signal, a second toggle flip-flop that outputs a second output signal, the second output signal changing in synchronization with the horizontal synchronization signal, a logic circuit that performs an exclusive-OR operation on the first output signal and the second output signal, and a flip-flop that outputs the polarity reversal signal based on the coincidence signal, and an output signal from the exclusive-OR operation of the logic circuit being input to the flip-flop.

2. An electro-optical device comprising:

a plurality of scan lines;

a plurality of data lines;

a plurality of pixel electrodes connected to the scan lines and the data lines;

a common electrode that faces the pixel electrodes with an electro-optical substance interposed; and the display driver as defined in claim 1.

3. An electro-optical device comprising:

a plurality of scan lines;

a plurality of data lines;

a plurality of pixel electrodes connected to the scan lines and the data lines;

a common electrode which faces the pixel electrodes with an electro-optical substance interposed; and the display driver as defined in claim 1.

4. An electro-optical device comprising:

a scan line;

first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements that are respectively switch-controlled by first to third demultiplex control signals, one ends of the first to third demultiplex switching elements being connected to the data line, and the other ends of the first to third demultiplex switching elements being respectively connected to the first to third color component switching elements;

a common electrode that faces the first to third pixel electrodes with an electro-optical substance interposed; and the display driver as defined in claim 1 that supplies a drive voltage to the data line, the drive voltage being based on one of the multiplexed first to third color component data signals.

5. An electro-optical device comprising:

a scan line;

first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements that are respectively switch-controlled by first to third demultiplex control signals, one ends of the first to third demultiplex switching elements being connected to the data line, and the other ends of the first to third demultiplex switching elements being respectively connected to the first to third color component switching elements;

a common electrode that faces the first to third pixel electrodes with an electro-optical substance interposed; and the display driver as defined in claim 1 that supplies a drive voltage to the data line, the drive voltage being based on one of the multiplexed first to third color component data signals.

6. A method of driving an electro-optical device, the electro-optical device including:

a scan line, first to third color component switching elements connected to the scan line, first to third pixel electrodes respectively connected to the first to third color component switching elements, a data line through which first to third color component data signals are transmitted in a multiplexed state, a plurality of demultiplexers each of which includes first to third demultiplex switching elements that are respectively switch-controlled by first to third demultiplex control signals, one ends of the first to third demultiplex switching elements being connected to the data line, and the other ends of the first to third demultiplex switching elements being respectively connected to the first to third color component switching elements, and a common electrode that faces the first to third pixel electrodes with an electro-optical substance interposed, the method comprising:

outputting a coincidence signal when counting a given number of pulses of a dot clock signal, count of the given number of pulses being started based on an edge of a horizontal synchronization signal;

outputting a first output signal that changes in synchronization with a vertical synchronization signal;

outputting a second output signal that changes in synchronization with the horizontal synchronization signal;

performing an exclusive-OR operation on the first output signal and the second output signal;

inputting an output signal from the exclusive-OR operation and outputting a polarity reversal signal based on the coincidence signal;

performing first to fourth steps on the demultiplexers in a state in which a common electrode voltage in synchronization with the polarity reversal signal is supplied to the common electrode, in the first step, all the first to third demultiplex switching elements being made electrically conductive by the first to third demultiplex control signals, and then all the first to third demultiplex switching elements being made non-conductive;

in the second step, only the first demultiplex switching element being made electrically conductive only for a period in which a drive voltage based on the first color component data signal is supplied to the first color component switching element;

in the third step, only the second demultiplex switching element being made electrically conductive only for a period in which a drive voltage based on the second color component data signal is supplied to the second color component switching element; and in the fourth step, only the third demultiplex switching element being made electrically conductive only for a period in which a drive voltage based on the third color component data signal is supplied to the third color component switching element.

7. The display driver as defined in claim 1, further comprising:

a data latch that fetches display data for one horizontal scan supplied in synchronization with the dot clock signal, the data line driver section being connected to a pixel electrode, the pixel electrode facing a common electrode with the electro-optical substance interposed, and the driver section supplies the drive voltage based on the display data fetched into the data latch to the data line so that the polarity of the voltage applied to the electro-optical substance is reversed in synchronization with the polarity reversal signal.

8. An electro-optical device comprising:

a plurality of scan lines;

a plurality of data lines;

a plurality of pixel electrodes connected to the scan lines and the data lines;

a common electrode that faces the pixel electrodes with an electro-optical substance interposed; and the display driver as defined in claim 7.

9. An electro-optical device comprising:

a scan line;

first to third color component switching elements connected to the scan line;

first to third pixel electrodes respectively connected to the first to third color component switching elements;

a data line through which first to third color component data signals are transmitted in a multiplexed state;

a plurality of demultiplexers each of which includes first to third demultiplex switching elements which are respectively switch-controlled by first to third demultiplex control signals, one ends of the first to third demultiplex switching elements being connected to the data line, and the other ends of the first to third demultiplex switching elements being respectively connected to the first to third color component switching elements;

a common electrode that faces the first to third pixel electrodes with an electro-optical substance interposed; and the display driver as defined in claim 7 that supplies a drive voltage to the data line, the drive voltage being based on one of the multiplexed first to third color component data signals.

* * * * *